US010077683B2

(12) United States Patent
Close

(10) Patent No.: US 10,077,683 B2
(45) Date of Patent: Sep. 18, 2018

(54) MASS MANAGEMENT SYSTEM FOR A SUPERCRITICAL WORKING FLUID CIRCUIT

(71) Applicants: ECHOGEN POWER SYSTEMS, L.L.C., Akron, OH (US); Cameron Close, Munroe Falls, OH (US)

(72) Inventor: Cameron Close, Munroe Falls, OH (US)

(73) Assignee: Echogen Power Systems LLC, Akron, OH (US)

( * ) Notice: Subject to any disclaimer, the term of this patent is extended or adjusted under 35 U.S.C. 154(b) by 351 days.

(21) Appl. No.: 14/776,200

(22) PCT Filed: Mar. 12, 2014

(86) PCT No.: PCT/US2014/024305
§ 371 (c)(1),
(2) Date: Sep. 14, 2015

(87) PCT Pub. No.: WO2014/159587
PCT Pub. Date: Oct. 2, 2014

(65) Prior Publication Data

US 2016/0010512 A1 Jan. 14, 2016

Related U.S. Application Data

(60) Provisional application No. 61/782,366, filed on Mar. 14, 2013.

(51) Int. Cl.
*F01K 25/08* (2006.01)
*F01K 25/06* (2006.01)
(Continued)

(52) U.S. Cl.
CPC ..... *F01K 25/06* (2013.01); *F01K 7/06* (2013.01); *F01K 7/32* (2013.01); *F01K 11/04* (2013.01);
(Continued)

(58) Field of Classification Search
CPC ..... F01K 11/04; F01K 13/02; F01K 23/18; F01K 25/06; F01K 25/103; F01K 7/06; F01K 7/32
See application file for complete search history.

(56) References Cited

U.S. PATENT DOCUMENTS 4,192,144 A * 3/1980 Pierce ..... F01K 3/00 122/28
4,235,077 A * 11/1980 Bryant ..... F01K 23/14 123/198 F
(Continued)

*Primary Examiner* — Jesse Bogue

(57) ABSTRACT

Provided herein is a heat engine system and a method for transforming energy, such as generating mechanical energy and/or electrical energy from thermal energy. The heat engine system may have one of several different configurations of a mass management system (MMS) fluidly coupled to a working fluid circuit. The MMS may be utilized to control the amount of working fluid added to, contained within, or removed from the working fluid circuit. The MMS may contain a mass control tank, an inventory transfer line, and system/tank transfer valves. The MMS may contain a transfer pump fluidly coupled to the inventory transfer line and configured to control the pressure in the inventory transfer line. The MMS may have two or more transfer lines, such as an inventory return line and valve, and an inventory supply line and valve.

12 Claims, 8 Drawing Sheets

(51) Int. Cl.

| | |
|---|---|
| ***F01K 7/06*** | (2006.01) |
| ***F01K 7/32*** | (2006.01) |
| ***F01K 13/02*** | (2006.01) |
| ***F01K 11/04*** | (2006.01) |
| ***F01K 23/18*** | (2006.01) |
| ***F01K 25/10*** | (2006.01) |

(52) U.S. Cl.
CPC ..... *F01K 13/02* (2013.01); *F01K 23/18* (2013.01); *F01K 25/103* (2013.01)

(56) References Cited

U.S. PATENT DOCUMENTS

| | | | | | |
|---|---|---|---|---|---|
| 5,351,487 | A * | 10/1994 | Abdelmalek | B60K 6/24 | 60/618 |
| 6,829,894 | B2 * | 12/2004 | Bloch | F01K 13/00 | 60/646 |
| 2005/0072182 | A1 * | 4/2005 | Taniguchi | F01K 9/00 | 62/467 |
| 2010/0133031 | A1 * | 6/2010 | Mendler | B60K 3/00 | 180/165 |
| 2010/0287920 | A1 * | 11/2010 | Duparchy | F01K 13/02 | 60/320 |
| 2011/0041523 | A1 * | 2/2011 | Taras | F25B 9/008 | 62/77 |
| 2011/0167818 | A1 * | 7/2011 | Tsuchino | F01K 13/02 | 60/618 |
| 2013/0276446 | A1 * | 10/2013 | Hall | F01K 23/065 | 60/615 |
| 2015/0013338 | A1 * | 1/2015 | Smague | F01K 13/02 | 60/645 |

* cited by examiner

MASS MANAGEMENT SYSTEM FOR A SUPERCRITICAL WORKING FLUID CIRCUIT

CROSS-REFERENCE TO RELATED APPLICATIONS

This application is a national stage application of PCT/US2014/024305, which was filed on Mar. 12, 2014, which claims priority to U.S. Prov. Appl. No. 61/782,366, which was filed on Mar. 14, 2013, the disclosures of which are incorporated herein by reference to the extent consistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles. Rankine and similar thermodynamic cycles are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

Generally, the pressure of the low-pressure side of a Rankine cycle, upstream from the system pump, must be controlled to protect expensive components within the heat engine system, to maintain desired pressures of the high-pressure side, and to maximize efficiencies of the heat engine. If the low-pressure side drops below the saturation point of the working fluid, cavitation can occur, which can damage the pump. On the other hand, the pressure ratio between the low-side and the high-side is directly related to the power generation of the system, with efficiency and power generation being highly sensitive to changes in the low-pressure side, even as compared to the high-pressure side.

Accordingly, it is desirable to maintain control of pressure in the low-pressure side. In the past, systems of vents, pressure containment vessels, and other equipment have been used as mass management systems, with a good degree of success, to maintain desired operation parameters. However, these systems often allow pressure to be vented to the system on nearly a constant basis. This represents wasted working fluid, which must be replenished on a periodic basis, thereby increasing operating costs.

Therefore, there is a need for a heat engine system, a mass management system, a method for regulating pressure in the heat engine system, and a method for generating electricity, whereby the systems and methods provide maintaining a fine control of the working fluid inventory within the system to have the desired range of pressure within the system, avoiding large pressure differentials in the low-pressure and high-pressure sides, avoiding ongoing ventilation of the process fluid, and maximizing the efficiency of the heat engine system to generate work or electricity.

SUMMARY

Embodiments of the disclosure generally provide a heat engine system and a method for transforming energy, such as generating mechanical energy and/or electrical energy from thermal energy. Embodiments provide that the heat engine system may have one of several different configurations of a mass management system (MMS) fluidly coupled to a working fluid circuit. The mass management system, also referred to as an inventory management system, may be utilized to control the amount of working fluid added to, contained within, or removed from the working fluid circuit.

In one embodiment, the mass management system may contain a mass control tank, an inventory transfer line, a system transfer valve, and a tank transfer valve, wherein the inventory transfer line is a single line with two-directional flow. In another embodiment, the mass management system may contain the mass control tank, the inventory transfer line as a two-way transfer line, the system transfer valve, the tank transfer valve, and may further contain a transfer pump and a transfer pump line. The transfer pump and the transfer pump line may be in fluid communication with the mass control tank and the inventory transfer line and configured to control the pressure of a section of the inventory transfer line disposed between the system and tank transfer valves. In another embodiment, instead of the single line with two-directional flow, such as the inventory transfer line, the mass management system may have two or more transfer lines that may be configured to have one-directional flow, such as return and supply lines. Therefore, the mass management system may contain the mass control tank and the transfer pump connected in series, and may further contain an inventory return line and valve and an inventory supply line and valve.

In one or more embodiments disclosed herein, a heat engine system is provided and contains a working fluid circuit having a high pressure side and a low pressure side and further contains a working fluid (e.g., carbon dioxide), wherein at least a portion of the working fluid circuit contains the working fluid in a supercritical state. The heat engine system also contains a heat exchanger fluidly coupled to and in thermal communication with the high pressure side of the working fluid circuit, configured to be fluidly coupled to and in thermal communication with a heat source, and configured to transfer thermal energy from the heat source to the working fluid within the high pressure side. The heat engine system further contains an expander fluidly coupled to the working fluid circuit and disposed between the high pressure side and the low pressure side and configured to convert a pressure drop in the working fluid to mechanical energy. The heat engine system also includes a driveshaft coupled to the expander and configured to drive a device with the mechanical energy. The heat engine system also contains at least one system pump fluidly coupled to the working fluid circuit between the low pressure side and the high pressure side of the working fluid circuit and configured to circulate or pressurize the working fluid within the working fluid circuit. Also, the heat engine system contains a recuperator fluidly coupled to the working fluid circuit and operative to transfer thermal energy between the high pressure side and the low pressure side of the working fluid circuit and a cooler in thermal communication with the working fluid in the low pressure side of the working fluid circuit and configured to remove thermal energy from the working fluid in the low pressure side of the working fluid circuit. The mass management system of the heat engine system may be fluidly coupled to the low pressure side of the working fluid circuit and may have a variety of different configurations as described in the embodiments herein.

In one embodiment, the mass management system may contain a mass control tank, an inventory transfer line, a system transfer valve, and a tank transfer valve. The inventory transfer line may be fluidly coupled to the low pressure side of the working fluid circuit and configured to transfer the working fluid from and to the working fluid circuit. The mass control tank may be fluidly coupled to the inventory transfer line and configured to receive, store, and dispense the working fluid. The system transfer valve may be fluidly coupled to the inventory transfer line and configured to control the transfer of the working fluid from and to the working fluid circuit and the tank transfer valve may be fluidly coupled to the inventory transfer line and configured to control the transfer of the working fluid from and to the mass control tank. The system transfer valve and the tank transfer valve may each independently be an isolation shut-off (ISO) valve, a modulating valve, or other type of valve. In some examples, the system transfer valve and the tank transfer valve are each an isolation shut-off valve or are each a modulating valve. In other examples, the system transfer valve is a modulating valve, and the tank transfer valve is an isolation shut-off valve.

In another embodiment described herein, a method for transferring the working fluid between the mass management system and the working fluid circuit within the heat engine system includes providing the system transfer valve in a closed position and the tank transfer valve in an opened position, circulating the working fluid within the working fluid circuit, providing a high pressure in the high pressure side of the working fluid circuit within a high pressure threshold range, and providing a low pressure in the low pressure side of the working fluid circuit within a low pressure threshold range. The method further includes monitoring the low pressure via a process control system operatively connected to the working fluid circuit, detecting an undesirable value of the low pressure via the process control system, wherein the undesirable value is less than or greater than the low pressure threshold range, adjusting the system transfer valve to an opened position, and transferring the working fluid between the working fluid circuit and the mass control tank. Also, the method includes detecting a desirable value of the low pressure via the process control system, wherein the desirable value is within the low pressure threshold range, and adjusting the system transfer valve to the closed position.

In some examples, the undesirable value is less than the low pressure threshold range; therefore, the working fluid may be transferred from the mass control tank to the low pressure side of the working fluid circuit to increase the pressure and mass of the working fluid in the working fluid circuit. Alternatively, in other examples, the undesirable value is greater than the low pressure threshold range and the working fluid may be transferred from the working fluid circuit to the mass control tank. Generally, the low pressure may be within the low pressure threshold range from about 4 MPa to about 14 MPa and the high pressure may be within the high pressure threshold range from about 15 MPa to about 30 MPa.

In one or more embodiments disclosed herein, the mass management system may contain the mass control tank, the inventory transfer line, the system transfer valve, and the tank transfer valve. The mass management system further contains a transfer pump and a transfer pump line in fluid communication with the mass control tank and the inventory transfer line and configured to control the pressure of a section of the inventory transfer line disposed between the system and tank transfer valves. The inventory transfer line may be fluidly coupled to the low pressure side of the working fluid circuit and configured to transfer the working fluid from and to the working fluid circuit and the mass control tank fluidly coupled to the inventory transfer line and configured to receive, store, and dispense the working fluid. The system transfer valve may be fluidly coupled to the inventory transfer line and configured to control the transfer of the working fluid from and to the working fluid circuit and a tank transfer valve fluidly coupled to the inventory transfer line and configured to control the transfer of the working fluid from and to the mass control tank. Also, the transfer pump may be in fluid communication with the mass control tank and the inventory transfer line and configured to control the pressure of a section of the inventory transfer line disposed between the system and tank transfer valves. The transfer pump may also be configured to transfer the working fluid from the mass control tank to the working fluid circuit. The transfer pump line may be fluidly coupled to and disposed between the mass control tank and the inventory transfer line. The transfer pump is fluidly coupled to the transfer pump line.

In some embodiments, the mass management system contains a restricted flow device fluidly coupled within the inventory transfer line and disposed between the system and tank transfer valves. The restricted flow device may be configured to reduce a flowrate of the working fluid flowing from the system transfer valve towards the tank transfer valve. The restricted flow device may be selected from a restriction orifice device, a critical flow device, a restriction orifice plate, a baffle, a tapering or narrowing line, a control valve, derivatives thereof, or combinations thereof. In some exemplary configurations of the mass management system, when the restricted flow device may be fluidly coupled within the inventory transfer line, the system transfer valve is an isolation shut-off valve. In other embodiments, the mass management system contains a bypass line in fluid communication with the inventory transfer line and configured to circumvent the restricted flow device and a bypass valve fluidly coupled to the inventory transfer line and configured to control the flow of the working fluid circumventing the restricted flow device. In some exemplary configurations, the mass management system contains the restricted flow device, a first end of the bypass line may be fluidly coupled to the inventory transfer line and disposed between the system transfer valve and the restricted flow device, and a second end of the bypass line may be fluidly coupled to the inventory transfer line and disposed between the tank transfer valve and the restricted flow device.

In other embodiments disclosed herein, a method for transferring the working fluid between the mass management system and the working fluid circuit within the heat engine system includes providing the system transfer valve in an opened position and the tank transfer valve in a closed position and circulating the working fluid within the working fluid circuit. The method further includes providing a high pressure in the high pressure side of the working fluid circuit within a high pressure threshold range, providing a low pressure in the low pressure side of the working fluid circuit within a low pressure threshold range, and pressurizing with the transfer pump the section of the inventory transfer line disposed between the system and tank transfer valves to a transfer pressure within the low pressure threshold range. The method also includes monitoring the low pressure via a process control system operatively connected to the working fluid circuit and detecting an undesirable value of the low pressure via the process control system, wherein the undesirable value is less than or greater than the low pressure threshold range.

The method further includes adjusting the tank transfer valve to transfer the working fluid between the working fluid circuit and the mass control tank, detecting a desirable value of the low pressure via the process control system, wherein the desirable value is within the low pressure threshold range, and adjusting the tank transfer valve to the closed position. In some examples, the method includes adjusting the tank transfer valve (e.g., ISO valve) to the opened position. In other examples, the method includes adjusting the tank transfer valve (e.g., modulating valve) by modulating the tank transfer valve. For example, the method may include modulating the system transfer valve while transferring the working fluid between the working fluid circuit and the mass control tank. In some examples, the undesirable value is less than the low pressure threshold range and the working fluid is transferred from the mass control tank to the working fluid circuit. Alternatively, in other examples, the undesirable value is greater than the low pressure threshold range and the working fluid is transferred from the working fluid circuit to the mass control tank.

In one or more embodiments disclosed herein, the mass management system may contain the mass control tank and the transfer pump connected in series, and may further contain an inventory return line, an inventory return valve, an inventory supply line, and an inventory supply valve. The inventory return line may be fluidly coupled to the low pressure side of the working fluid circuit and configured to transfer the working fluid from the working fluid circuit. The mass control tank may be fluidly coupled to the inventory return line and configured to receive, store, and dispense the working fluid. The mass management system may also contain the transfer pump fluidly coupled to the mass control tank and configured to transfer the working fluid from the mass control tank to the working fluid circuit. The inventory supply line may be fluidly coupled to the low pressure side of the working fluid circuit and configured to transfer the working fluid into the working fluid circuit.

The inventory return line may be fluidly coupled to and between the mass control tank and the low pressure side of the working fluid circuit, and the inventory return line may be coupled to the working fluid circuit at a point downstream of the condenser. The mass management system further contains the inventory return valve fluidly coupled to the inventory return line and configured to control the rate of the working fluid flowing from the low pressure side of the working fluid circuit, through the inventory return line, and into the mass control tank. The inventory supply line may be fluidly coupled to and between the transfer pump and the low pressure side of the working fluid circuit upstream of the system pump. Also, the inventory supply valve may be fluidly coupled to the inventory supply line and configured to control the rate of the working fluid flowing from the mass control tank, through the inventory supply line, and into the low pressure side of the working fluid circuit.

In other embodiments, the mass management system may further contain a restricted flow device fluidly coupled within the inventory return line and disposed between the inventory return valve and the mass control tank. The restricted flow device may be configured to reduce a flow-rate of the working fluid flowing from the inventory return valve towards the mass control tank. The restricted flow device may be selected from a restriction orifice device, a critical flow device, a restriction orifice plate, a baffle, a tapering or narrowing line, a control valve, derivatives thereof, or combinations thereof.

In some embodiments, the mass management system further contains an inventory return valve and an inventory supply valve. The inventory return valve may be fluidly coupled to the inventory return line and configured to control the rate of the working fluid flowing from the low pressure side of the working fluid circuit, through the inventory return line, and into the mass control tank. The inventory supply valve may be fluidly coupled to the inventory supply line and configured to control the rate of the working fluid flowing from the mass control tank, through the inventory supply line, and into the low pressure side of the working fluid circuit.

In other embodiments disclosed herein, a method for transferring the working fluid between the mass management system and the working fluid circuit within the heat engine system includes providing the inventory return valve in a closed position and the inventory supply valve in a closed position and circulating the working fluid within the working fluid circuit. The method further includes providing a high pressure in the high pressure side of the working fluid circuit within a high pressure threshold range and providing a low pressure in the low pressure side of the working fluid circuit within a low pressure threshold range. Also, the method includes monitoring the low pressure via a process control system operatively connected to the working fluid circuit and detecting an undesirable value of the low pressure via the process control system, wherein the undesirable value is less than or greater than the low pressure threshold range. The method further includes adjusting the inventory return valve or the inventory supply valve to transfer the working fluid between the working fluid circuit and the mass control tank, detecting a desirable value of the low pressure via the process control system, wherein the desirable value is within the low pressure threshold range, and adjusting the inventory return valve or the inventory supply valve to the closed position.

In some examples, the method includes determining the undesirable value of the low pressure is greater than the low pressure threshold range and adjusting the inventory return valve to transfer the working fluid from the working fluid circuit, through the inventory return line, and to the mass control tank. In other examples, the method includes determining the undesirable value of the low pressure is less than the low pressure threshold range and adjusting the inventory supply valve to transfer the working fluid from the mass control tank, through the inventory supply line, and to the working fluid circuit. The method generally includes pressurizing the inventory supply line with the transfer pump to a transfer pressure within the low pressure threshold range. In some examples, the method includes adjusting the tank transfer valve to transfer the working fluid by modulating the tank transfer valve. In other examples, the method includes modulating the system transfer valve while transferring the working fluid between the working fluid circuit and the mass control tank.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Embodiments of the disclosure generally provide a heat engine system and a method for transforming energy, such as generating mechanical energy and/or electrical energy from thermal energy. Embodiments provide that the heat engine system may have one of several different configurations of a mass management system (MMS) fluidly coupled to a working fluid circuit. The mass management system, also referred to as an inventory management system, may be utilized to control the amount of working fluid added to, contained within, or removed from the working fluid circuit.

The heat engine system and the method for transforming energy are configured to efficiently convert thermal energy of a heated stream (e.g., a waste heat stream) into valuable mechanical energy and/or electrical energy. The heat engine system utilizes the working fluid in a supercritical state (e.g., sc-$CO_2$) and/or a subcritical state (e.g., sub-$CO_2$) contained within the working fluid circuit for capturing or otherwise absorbing thermal energy of the waste heat stream with one or more heat exchangers. The thermal energy may be transformed to mechanical energy by a power turbine and subsequently transformed to electrical energy by a power generator coupled to the power turbine. The heat engine system contains several integrated sub-systems managed by a process control system for maximizing the efficiency of the heat engine system while generating mechanical energy and/or electrical energy.

Figure 1:
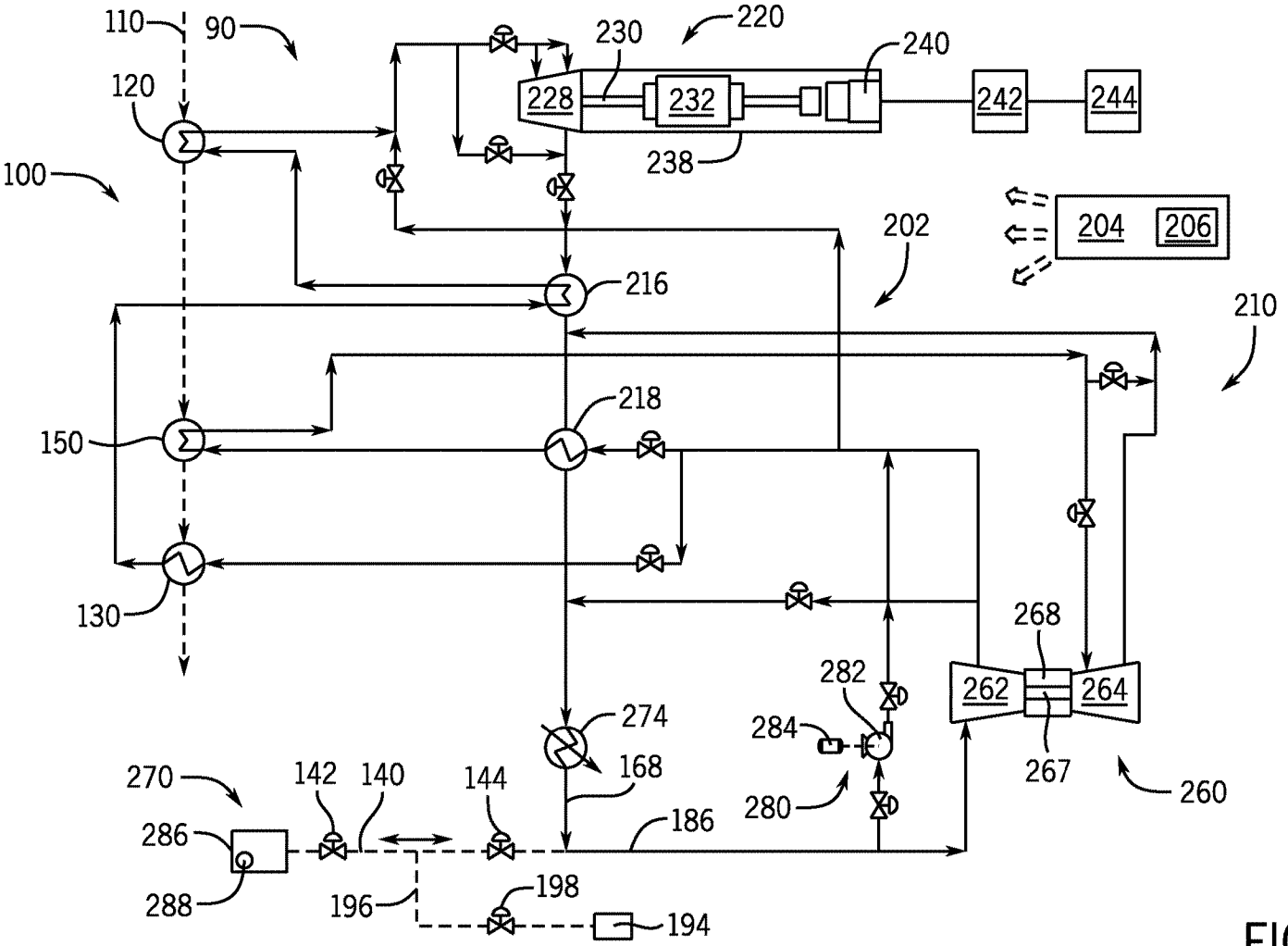
FIG. 1 depicts an exemplary heat engine system containing a mass management system with a two-way, inventory transfer line and a mass control tank, according to one or more embodiments disclosed herein.
Figure 2:
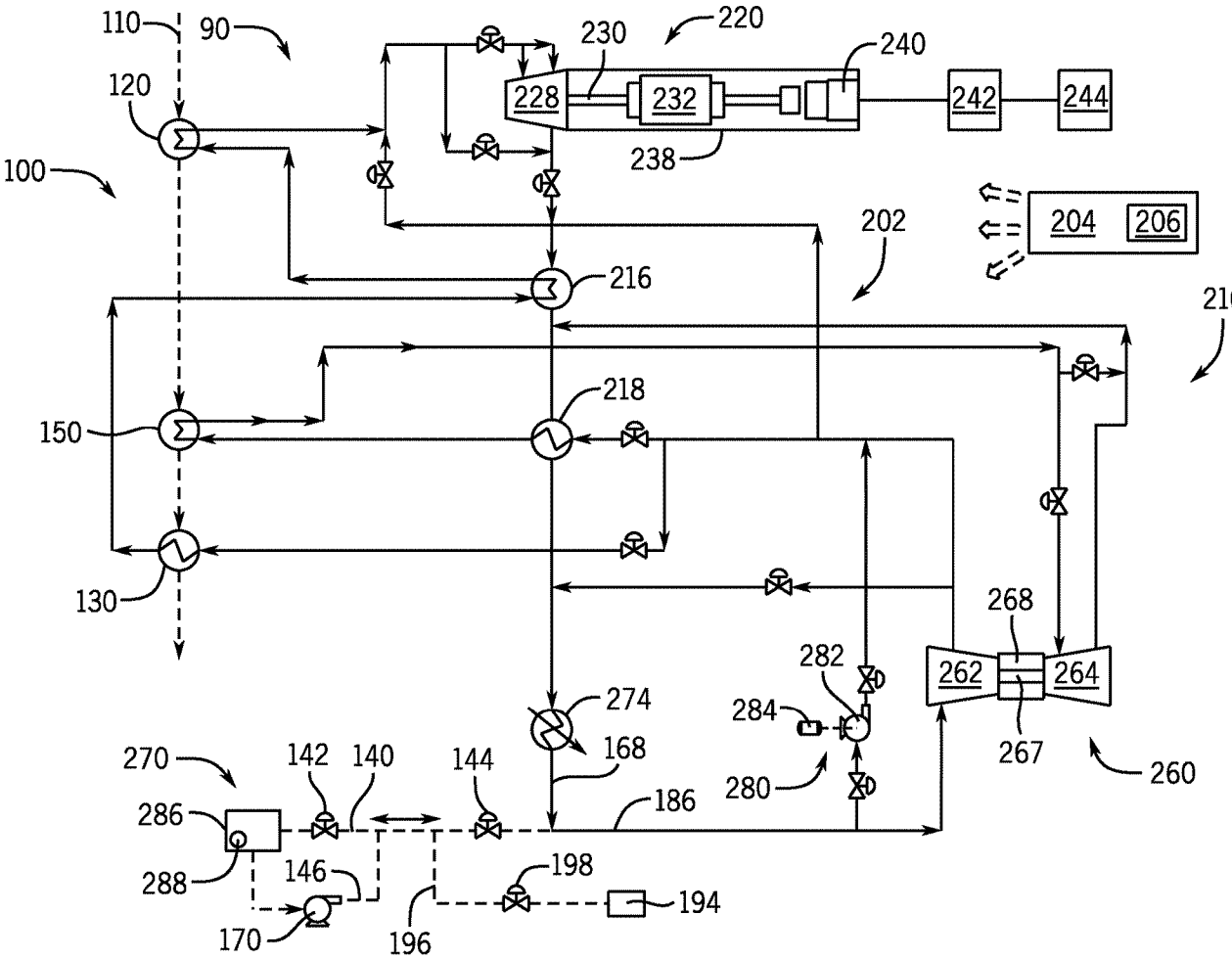
FIG. 2 depicts an exemplary heat engine system containing a mass management system with a two-way, inventory transfer line, a mass control tank, and a transfer pump, according to one or more embodiments disclosed herein.
Figure 3:
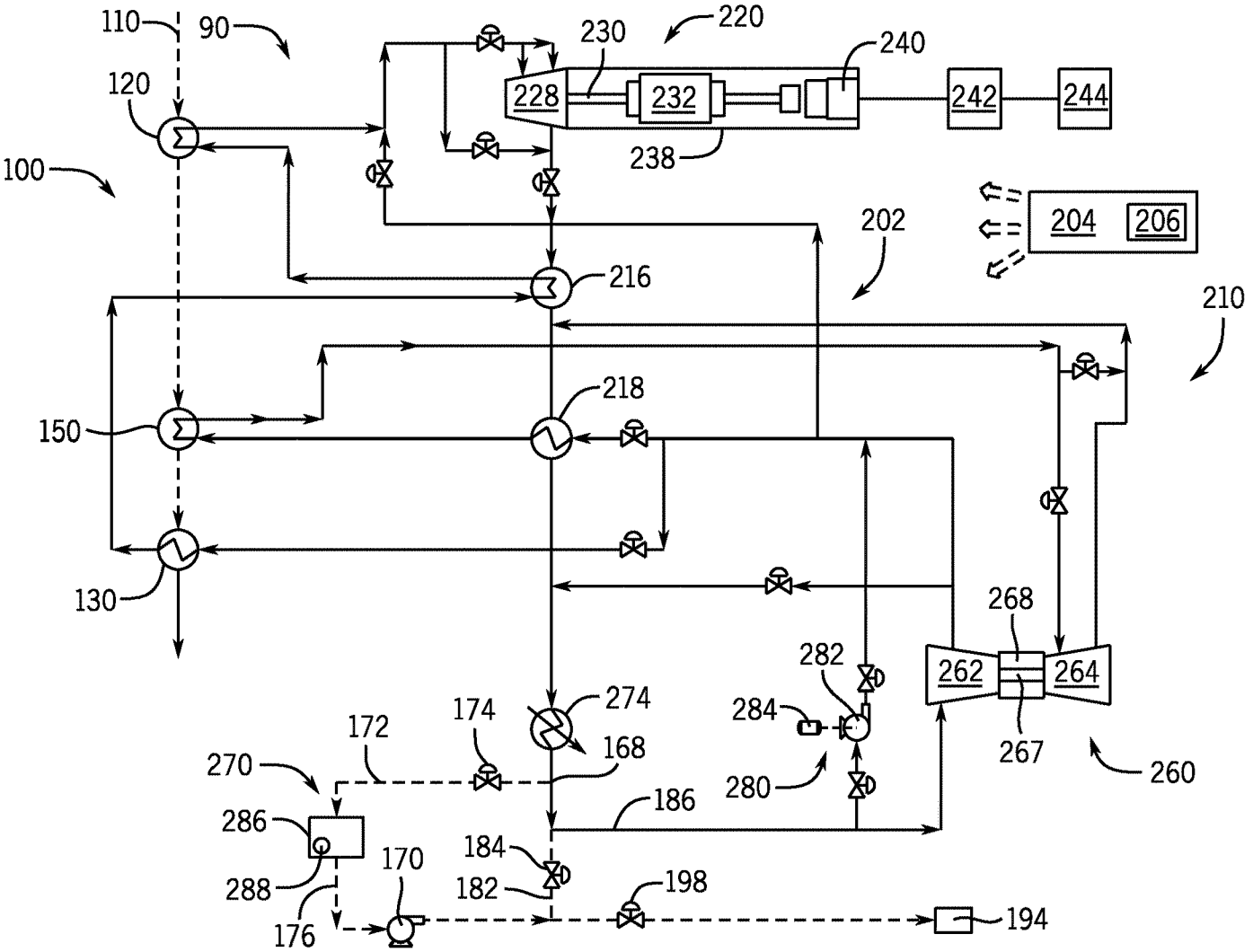
FIG. 3 depicts an exemplary heat engine system containing a mass management system with an inventory return line and valve, an inventory supply line and valve, a mass control tank, and a transfer pump, according to one or more embodiments disclosed herein.
Figure 4:
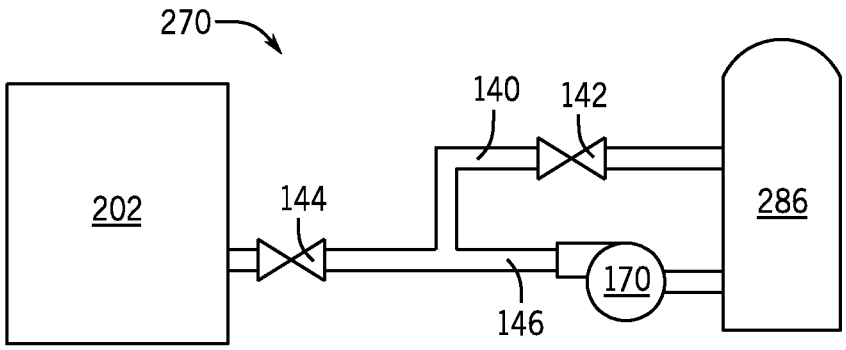
FIG. 4 depicts an exemplary mass management system containing an inventory transfer line, system/tank transfer valves, a mass control tank, and a transfer pump, according to one or more embodiments disclosed herein.

Each of the FIGS. 1-3 depicts a heat engine system 90 containing one of several different configurations of a mass management system (MMS) 270 fluidly coupled to a working fluid circuit 202, as described by embodiments herein. The mass management system 270, also referred to as an inventory management system, may be utilized to control the amount of working fluid added to, contained within, or removed from the working fluid circuit 202.

In one embodiment, depicted in FIG. 1, the mass management system 270 may contain a mass control tank 286, an inventory transfer line 140, a system transfer valve 144, and a tank transfer valve 142. The inventory transfer line 140 is configured to have two-directional flow and may be utilized to transfer the working fluid to and from the mass control tank 286 and the working fluid circuit 202.

In another embodiment, depicted in FIG. 2, the mass management system 270 may contain the mass control tank 286, the inventory transfer line 140, the system transfer valve 144, the tank transfer valve 142, and may further contain a transfer pump 170 and a transfer pump line 146. The transfer pump 170 and the transfer pump line 146 may be in fluid communication with the mass control tank 286 and the inventory transfer line 140 and configured to control the pressure of a section of the inventory transfer line 140 disposed between the system transfer valve 144 and the tank transfer valve 142. The transfer pump 170 may be an electric-motorized pump, a mechanical-motorized pump, a variable frequency driven pump, a turbopump, or another type of pump.

In another embodiment, depicted in FIG. 3, instead of a single line with two-directional flow, such as the inventory transfer line 140 illustrated in FIGS. 1 and 2, the mass management system 270 may have two or more transfer lines that may be configured to have one-directional flow, such an inventory return line 172 and an inventory supply line 182. Therefore, the mass management system 270 may contain the mass control tank 286 and the transfer pump 170 connected in series by an inventory line 176 and may further contain the inventory return line 172 and the inventory supply line 182. The inventory return line 172 may be fluidly coupled between the working fluid circuit 202 and the mass control tank 286 and contains an inventory return valve 174 configured to remove the working fluid from the working fluid circuit 202. Also, the inventory supply line 182 may be fluidly coupled between the transfer pump 170 and the working fluid circuit 202 and contains an inventory supply valve 184 configured to add the working fluid into the working fluid circuit 202.

FIGS. 1-3 depict an exemplary heat engine system 90, which may also be referred to as a thermal engine system, an electrical generation system, a waste heat or other heat recovery system, and/or a thermal to electrical energy system, as described in one or more embodiments herein. The heat engine system 90 contains a waste heat system 100 and a power generation system 220 coupled to and in thermal communication with each other via a working fluid circuit 202. The working fluid circuit 202 contains the working fluid (e.g., sc-$CO_2$) and has a high pressure side and a low pressure side. A heat source stream 110 flows through heat exchangers 120, 130, and/or 150 disposed within the waste heat system 100. Each of the heat exchangers 120, 130, and/or 150, independently, may be fluidly coupled to and in thermal communication with the high pressure side of the working fluid circuit 202, configured to be fluidly coupled to and in thermal communication with a heat source stream 110, and configured to transfer thermal energy from the heat source stream 110 to the working fluid within the high pressure side of the working fluid circuit 202. Thermal energy may be absorbed by the working fluid within the working fluid circuit 202 and converted to mechanical energy by flowing the heated working fluid through one or more expanders or turbines.

The heat engine system 90 further contains several pumps, such as a turbopump 260 and a start pump 280, disposed within the working fluid circuit 202 and fluidly coupled between the low pressure side and the high pressure side of the working fluid circuit 202. The turbopump 260 and the start pump 280 may be configured to circulate and to pressurize the working fluid throughout the working fluid circuit 202. The turbopump 260 contains a pump portion 262 coupled with a drive turbine 264, and the start pump 280 contains a pump portion 282 and a motor-drive portion 284. In various examples, the start pump 280 may be an electric-motorized pump, a mechanical-motorized pump, or a variable frequency driven pump. The drive turbine 264 of the turbopump 260 may be fluidly coupled to the working fluid circuit 202 downstream of the heat exchanger 150, and the pump portion 262 of the turbopump 260 may be fluidly coupled to the working fluid circuit 202 upstream of the heat exchanger 120. In one example, the drive turbine 264 may be configured to receive and be powered by the working fluid passing through and absorbing thermal energy from the heat exchanger 150. The turbopump 260 may further contain a gearbox and/or a driveshaft 267 coupled between the drive turbine 264 and the pump portion 262. The turbopump 260 further contains a bearing housing 268, which substantially encompasses or encloses the bearings disposed within the turbopump 260.

The heat engine system 90 further contains a power turbine 228 disposed between the high pressure side and the low pressure side of the working fluid circuit 202, fluidly coupled to and in thermal communication with the working fluid, and configured to convert thermal energy to mechanical energy by a pressure drop in the working fluid flowing between the high and the low pressure sides of the working fluid circuit 202. A power generator 240 may be coupled to the power turbine 228 and configured to convert the mechanical energy into electrical energy. A power outlet 242 may be electrically coupled to the power generator 240 and configured to transfer the electrical energy from the power generator 240 to an electrical grid 244. The power turbine 228 disposed within the power generation system 220 may be fluidly coupled to the working fluid circuit 202 downstream of the heat exchanger 120 and/or heat exchanger 130. In one example, the power turbine 228 may be configured to receive and be powered by the working fluid passing through and absorbing thermal energy from the heat exchanger 120 and/or heat exchanger 130. The power generation system 220 may further contain a gearbox 232 and a driveshaft 230 coupled between the power turbine 228 and the power generator 240. The power generation system 220 further contains a bearing housing 238 which substantially encompasses or encloses the bearings disposed within the power generation system 220.

The heat engine system 90 further contains at least one recuperator, such as recuperators 216 and 218, fluidly coupled to the working fluid circuit and operative to transfer thermal energy between the high and low pressure sides of the working fluid circuit 202. In some examples, the recuperators 216 and 218 are configured to transfer the thermal energy from the low pressure side to the high pressure side. The heat engine system 90 further contains a condenser 274 in thermal communication with the working fluid contained in the low pressure side of the working fluid circuit 202 and configured to remove thermal energy from the working fluid in the low pressure side. In some examples, the condenser 274 may be a cooler configured to control a temperature of the working fluid in the low pressure side of the working fluid circuit 202 by transferring thermal energy from the working fluid in the low pressure side to a cooling loop outside of the working fluid circuit 202.

In one or more embodiments disclosed herein, a heat engine system 90, as depicted in FIGS. 1-3, is provided and contains a working fluid circuit 202 having a high pressure side and a low pressure side and containing a working fluid (e.g., carbon dioxide), wherein at least a portion of the working fluid circuit 202 contains the working fluid in a supercritical state. The heat engine system 90 also contains at least one heat exchanger, such as heat exchangers 120, 130, and 150, fluidly coupled to and in thermal communication with the high pressure side of the working fluid circuit 202, configured to be fluidly coupled to and in thermal communication with a heat source 110, and configured to transfer thermal energy from the heat source 110 to the working fluid within the high pressure side. The heat engine system 90 further contains an expander, such as a power turbine 228, fluidly coupled to the working fluid circuit 202 and disposed between the high pressure side and the low pressure side and configured to convert a pressure drop in the working fluid to mechanical energy and a driveshaft or rotating shaft, such as a driveshaft 230, coupled to the power turbine 228 and configured to drive a device, such as a power generator 240, with the mechanical energy. In other embodiments, the expander may be a drive turbine, such as a drive turbine 264, and coupled to and configured to drive a pump, such as a pump portion 262 of the turbopump 260, by a driveshaft or rotating shaft, such as a driveshaft 267.

The heat engine system 90 also contains at least one system pump (e.g., the turbopump 260 and/or the start pump 280) fluidly coupled to the working fluid circuit 202 between the low pressure side and the high pressure side of the working fluid circuit 202 and configured to circulate or pressurize the working fluid within the working fluid circuit 202. Also, the heat engine system 90 contains at least one recuperator, such as the recuperators 216 and 218, fluidly coupled to the working fluid circuit 202 and operative to transfer thermal energy between the high pressure side and the low pressure side of the working fluid circuit 202. The heat engine system 90 further contains a cooler, such as a condenser 274, in thermal communication with the working fluid in the low pressure side of the working fluid circuit 202 and configured to remove thermal energy from the working fluid in the low pressure side of the working fluid circuit 202. Also, the heat engine system 90 further includes the mass management system (MMS) 270 fluidly coupled to the low pressure side of the working fluid circuit 202.

FIG. 1 depicts the mass management system 270 containing a mass control tank 286, an inventory transfer line 140, a system transfer valve 144, and a tank transfer valve 142, as described in one or more embodiments herein. The inventory transfer line 140 may be fluidly coupled to the low pressure side of the working fluid circuit 202 and configured to transfer the working fluid from and to the working fluid circuit 202. The mass control tank 286 may be fluidly coupled to the inventory transfer line 140 and configured to receive, store, and dispense the working fluid. The mass control tank 286 may be a cryogenic storage vessel, such as a Dewar or the like, utilized for storing or otherwise containing the working fluid. Additional or supplemental working fluid may be added to the mass control tank 286, hence, added to the mass management system 270 and the working fluid circuit 202, from an external source, such as by a fluid fill system via at least one connection point or fluid fill port, such as a working fluid feed 288. In some examples, the working fluid contained in the mass control tank 286 may have been removed from the working fluid circuit 202 or externally added via the working fluid feed 288 and may be utilized by charging the working fluid circuit 202, delivering to the bearing housings or other components of the heat engine system 90.

The system transfer valve 144 may be fluidly coupled to the inventory transfer line 140 and configured to control the transfer of the working fluid from and to the working fluid circuit 202, and the tank transfer valve 142 may be fluidly coupled to the inventory transfer line 140 and configured to control the transfer of the working fluid from and to the mass control tank 286. The system transfer valve 144 and the tank transfer valve 142 may each independently be an isolation shut-off (ISO) valve, a modulating valve, or other type of valve. In some examples, the system transfer valve 144 and the tank transfer valve 142 are each an isolation shut-off valve or are each a modulating valve. In other examples, the system transfer valve 144 is a modulating valve, and the tank transfer valve 142 is an isolation shut-off valve.

In some configurations, the heat engine system 90 may further contain a bearing gas supply line 196 fluidly coupled to and between the inventory transfer line 140 and a bearing-containing device 194, as depicted in FIGS. 1-3. The bearing-containing device 194, for example, may be the bearing housing 268 of the turbopump 260, the bearing housing 238 of the power generation system 220, or other components containing bearings utilized within or along with the heat engine system 90. The bearing gas supply line 196 generally contains at least one valve, such as bearing gas supply valve 198, configured to control the flow of the working fluid from the inventory transfer line 140, through the bearing gas supply line 196, and to bearing-containing device 194. In another aspect, the bearing gas supply line 196 may be utilized during a startup process to transfer or otherwise deliver the working fluid—as a cooling agent—to bearings contained within a bearing housing of a system component (e.g., rotary equipment or turbo machinery).

Figure 9:
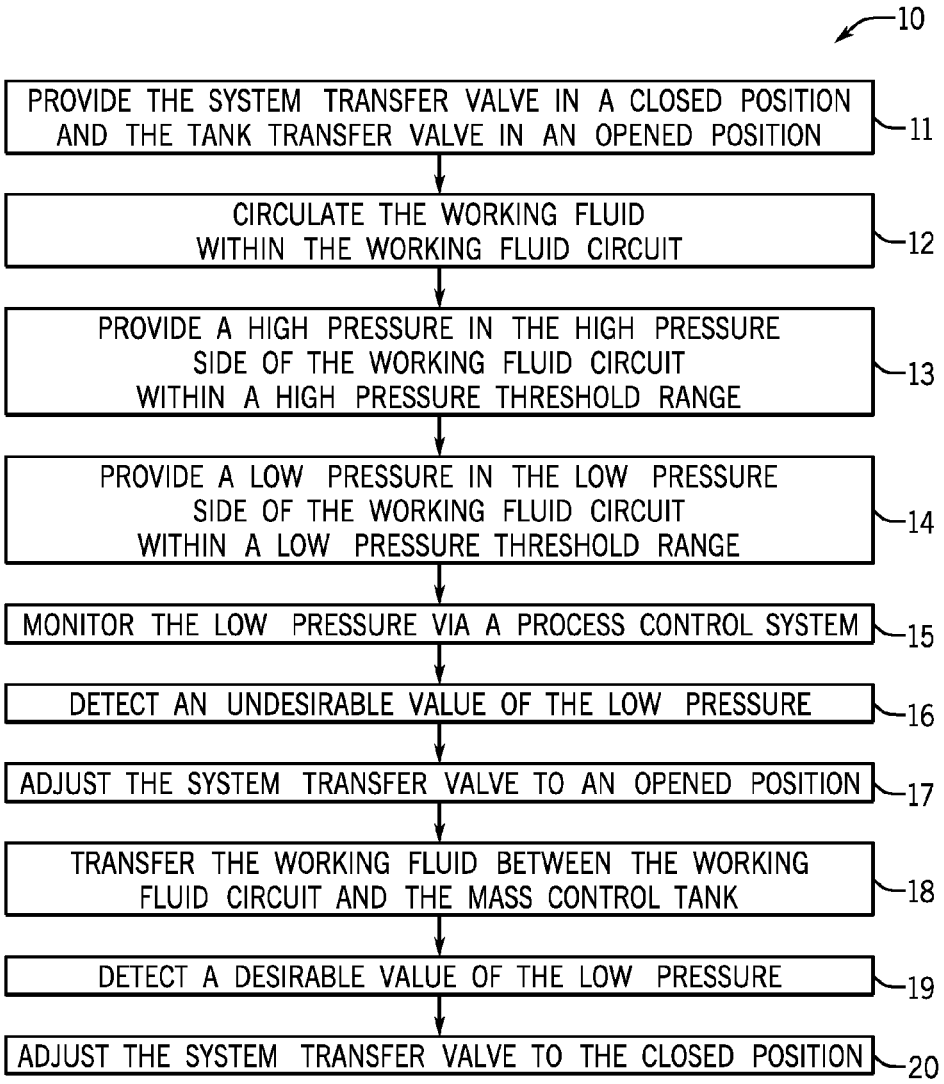
FIG. 9 is a flow chart depicting a method for transferring working fluid between a mass management system and a working fluid circuit, according to one or more embodiments disclosed herein.

In other embodiments disclosed herein, as illustrated in FIG. 9, a method 10 for transferring the working fluid between the mass management system 270 and the working fluid circuit 202 is provided. In some examples, the method 10 may be utilized by the mass management system 270 and the working fluid circuit 202, as depicted in FIG. 1. The method 10 includes providing the system transfer valve 144 in a closed position and the tank transfer valve 142 in an opened position (block 11), circulating the working fluid within the working fluid circuit 202 (block 12), providing a high pressure in the high pressure side of the working fluid circuit 202 within a high pressure threshold range (block 13), and providing a low pressure in the low pressure side of the working fluid circuit 202 within a low pressure threshold range (block 14). The method 10 further includes monitoring the low pressure via a process control system 204 operatively connected to the working fluid circuit 202 (block 15), detecting an undesirable value of the low pressure via the process control system 204 (block 16), wherein the undesirable value is less than or greater than the low pressure threshold range, adjusting the system transfer valve 144 to an opened position (block 17), and transferring the working fluid between the working fluid circuit 202 and the mass control tank 286 (block 18). Also, the method 10 includes detecting a desirable value of the low pressure via the process control system 204 (block 19), wherein the desirable value is within the low pressure threshold range, and adjusting the system transfer valve 144 to the closed position (block 20).

In some examples, the undesirable value is less than the low pressure threshold range; therefore, the working fluid may be transferred from the mass control tank 286 to the low pressure side of the working fluid circuit 202 to increase the pressure and mass of the working fluid in the working fluid circuit 202. Alternatively, in other examples, the undesirable value is greater than the low pressure threshold range, and the working fluid may be transferred from the working fluid circuit 202 to the mass control tank 286. Generally, the low pressure may be within the low pressure threshold range from about 4 MPa to about 14 MPa and the high pressure may be within the high pressure threshold range from about 15 MPa to about 30 MPa.

FIGS. 2 and 4-6 depict the mass management system 270 containing the mass control tank 286, the inventory transfer line 140, the system transfer valve 144, the tank transfer valve 142, and further containing a transfer pump 170 and a transfer pump line 146 in fluid communication with the mass control tank 286 and the inventory transfer line 140, as described in one or more embodiments herein. The transfer pump 170 and the transfer pump line 146 may be configured to control the pressure within the section of the inventory transfer line 140 disposed between the tank transfer valve 142 and the system transfer valve 144. The inventory transfer line 140 may be fluidly coupled to the low pressure side of the working fluid circuit 202 and configured to transfer the working fluid from and to the working fluid circuit 202 and the mass control tank 286. The mass control tank 286 may be fluidly coupled to the inventory transfer line 140 and configured to receive, store, and dispense the working fluid. The system transfer valve 144 may be fluidly coupled to the inventory transfer line 140 and configured to control the transfer of the working fluid from and to the working fluid circuit 202. A tank transfer valve 142 may be fluidly coupled to the inventory transfer line 140 and configured to control the transfer of the working fluid from and to the mass control tank 286. Also, the transfer pump 170 may be in fluid communication with the mass control tank 286 and the inventory transfer line 140 and configured to control the pressure within the section of the inventory transfer line 140 disposed between the tank transfer valve 142 and the system transfer valve 144. The transfer pump 170 may also be configured to transfer the working fluid from the mass control tank 286 to the working fluid circuit 202. The transfer pump line 146 may be fluidly coupled to and disposed between the mass control tank 286 and the inventory transfer line 140. The transfer pump 170 is fluidly coupled to the transfer pump line 146.

Figure 5:
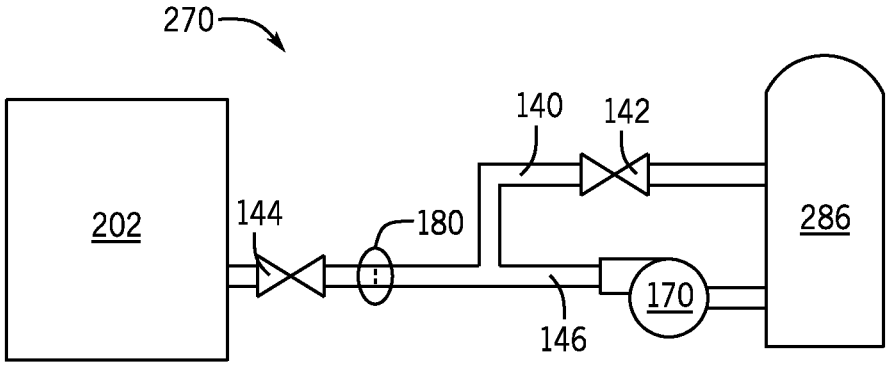
FIG. 5 depicts an exemplary mass management system containing an inventory transfer line, system/tank transfer valves, a mass control tank, a transfer pump, and a restricted flow device, according to one or more embodiments disclosed herein.
Figure 6:
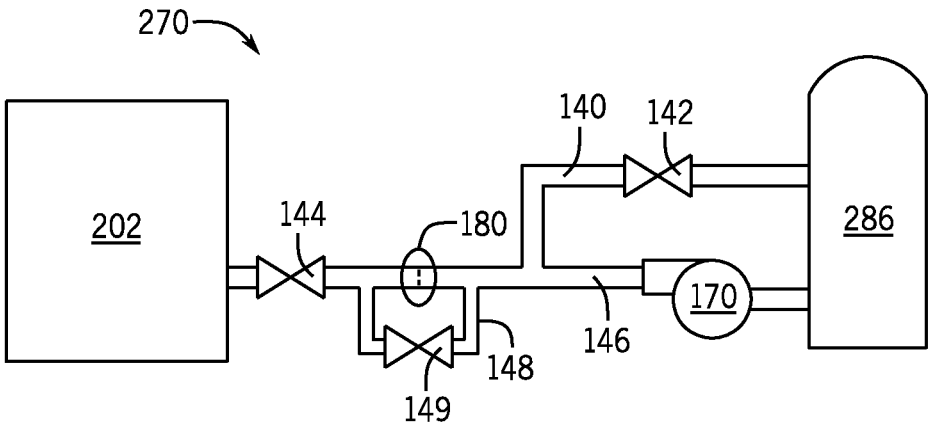
FIG. 6 depicts an exemplary mass management system containing an inventory transfer line, system/tank transfer valves, a mass control tank, a transfer pump, a restricted flow device, and a bypass line and valve, according to one or more embodiments disclosed herein.

In some embodiments, the mass management system 270 contains a restricted flow device 180 fluidly coupled within the inventory transfer line 140 and disposed between the tank transfer valve 142 and the system transfer valve 144, as depicted in FIGS. 5 and 6. The restricted flow device 180 may be configured to reduce a flowrate of the working fluid flowing from the system transfer valve 144 towards the tank transfer valve 142. The restricted flow device 180 may be selected from a restriction orifice device, a critical flow device, a restriction orifice plate, a baffle, a tapering or narrowing line, a control valve, derivatives thereof, or combinations thereof. In one example, a restriction orifice plate, utilized as the restricted flow device 180, may be a plate containing a passageway/hole or multiple passageways/holes, and each passageway or hole has a predetermined diameter for providing controlled passage of the working fluid therethrough. In another example, a narrowing line, utilized as the restricted flow device 180, may be a junction of two fluid lines of different diameters, such that the larger diameter line is upstream of the smaller diameter line. In another example, a tapering line, utilized as the restricted flow device 180, may contain a transition to a smaller diameter of the fluid line. In some exemplary configurations of the mass management system 270, if the system transfer valve 144 is an isolation shut-off valve, then the restricted flow device 180 may be fluidly coupled within the inventory transfer line 140 and utilized to reduce the flowrate therein.

In other embodiments, the mass management system 270 contains a bypass line 148 and a bypass valve 149 in fluid communication with the inventory transfer line 140, as depicted in FIG. 6. The bypass line 148 may be configured to flow the working fluid around, such as to circumvent, the restricted flow device 180. The bypass valve 149 may be fluidly coupled to the inventory transfer line 140 and configured to control the flow of the working fluid circumventing the restricted flow device 180. In an exemplary configuration, a first end of the bypass line 148 may be fluidly coupled to the inventory transfer line 140 and disposed between the system transfer valve 144 and the restricted flow device 180, and a second end of the bypass line 148 may be fluidly coupled to the inventory transfer line 140 and disposed between the tank transfer valve 142 and the restricted flow device 180. Generally, the bypass line 148 and the bypass valve 149 may be utilized to alleviate a build-up or bottle-necking of the working fluid upstream of the restricted flow device 180 during a process having an increased flowrate of the working fluid through the inventory transfer line 140.

Figure 10:
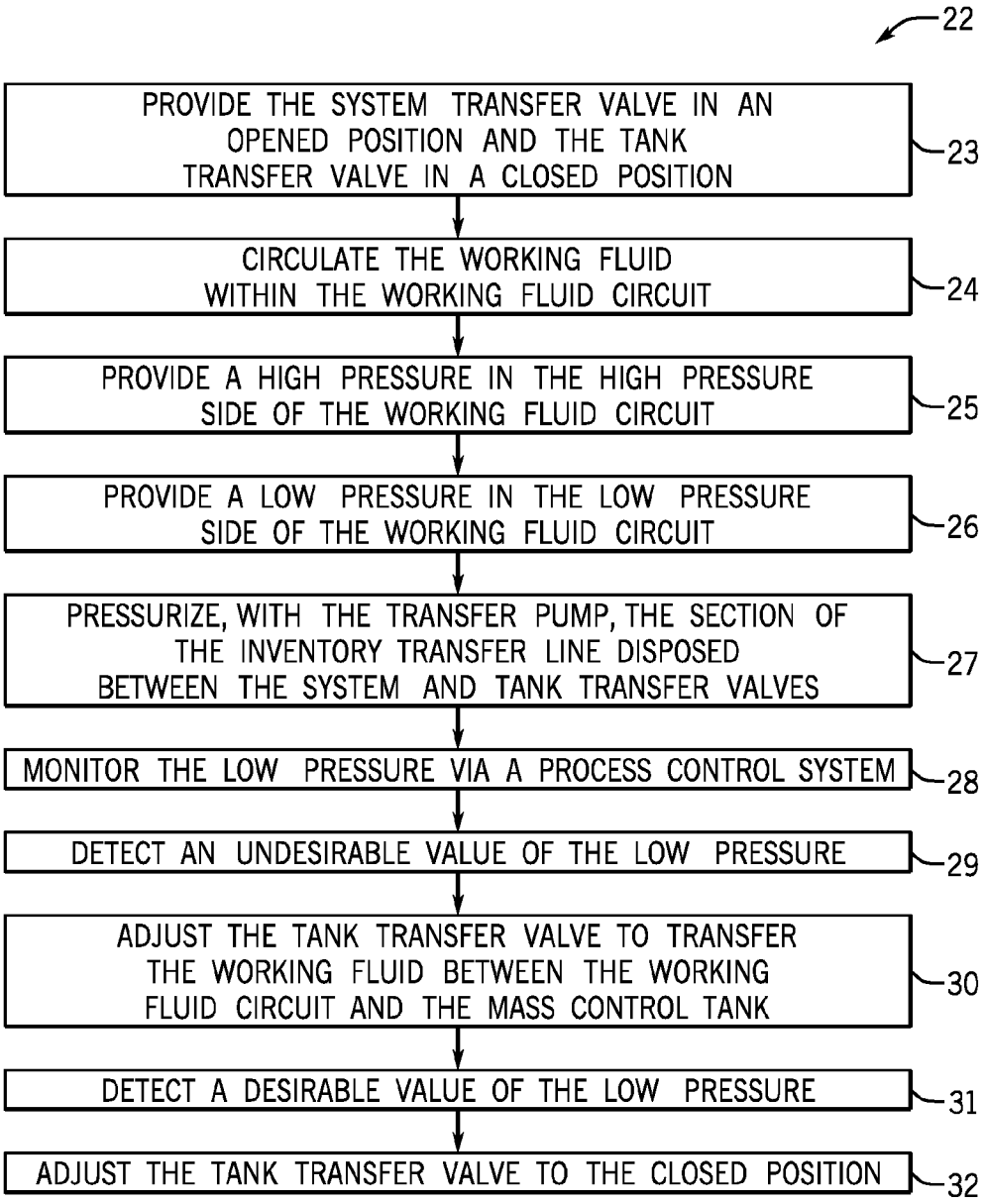
FIG. 10 is a flow chart depicting another method for transferring working fluid between a mass management system and a working fluid circuit, according to one or more embodiments disclosed herein.

In other embodiments disclosed herein, as shown in FIG. 10, a method 22 for transferring the working fluid between the mass management system 270 and the working fluid circuit 202 is provided herein. In some examples, the method 22 may be utilized by the mass management system 270 and the working fluid circuit 202, as depicted in FIGS. 2 and 4-6. The method 22 includes providing the system transfer valve 144 in an opened position and the tank transfer valve 142 in a closed position (block 23) and circulating the working fluid within the working fluid circuit 202 (block 24). The method 22 further includes providing a high pressure in the high pressure side of the working fluid circuit 202 within a high pressure threshold range (block 25), providing a low pressure in the low pressure side of the working fluid circuit 202 within a low pressure threshold range (block 26), and pressurizing, with the transfer pump 170, the section of the inventory transfer line 140 disposed between the tank transfer valve 142 and the system transfer valve 144 to a transfer pressure within the low pressure threshold range (block 27). The method 22 also includes monitoring the low pressure via a process control system 204 operatively connected to the working fluid circuit 202 (block 28) and detecting an undesirable value of the low pressure via the process control system 204 (block 29), wherein the undesirable value is less than or greater than the low pressure threshold range. The method 22 further includes adjusting the tank transfer valve 142 to transfer the working fluid between the working fluid circuit 202 and the mass control tank 286 (block 30), detecting a desirable value of the low pressure via the process control system 204 (block 31), wherein the desirable value is within the low pressure threshold range, and adjusting the tank transfer valve 142 to the closed position (block 32).

In some examples, the undesirable value is less than the low pressure threshold range; therefore, the working fluid may be transferred from the mass control tank 286 to the low pressure side of the working fluid circuit 202 to increase the pressure and mass of the working fluid in the working fluid circuit 202. Alternatively, in other examples, the undesirable value is greater than the low pressure threshold range, and the working fluid may be transferred from the working fluid circuit 202 to the mass control tank 286. Generally, the low pressure may be within the low pressure threshold range from about 4 MPa to about 14 MPa, and the high pressure may be within the high pressure threshold range from about 15 MPa to about 30 MPa.

In some examples, adjusting the tank transfer valve 142 (e.g., ISO valve) to transfer the working fluid includes adjusting the tank transfer valve 142 to the opened position. In other examples, the method includes adjusting the tank transfer valve 142 (e.g., modulating valve) to transfer the working fluid by modulating the tank transfer valve 142. For example, the method may include modulating the system transfer valve 144 while transferring the working fluid between the working fluid circuit 202 and the mass control tank 286. In some examples, the undesirable value is less than the low pressure threshold range, and the working fluid is transferred from the mass control tank 286 to the working fluid circuit 202. Alternatively, in other examples, the undesirable value is greater than the low pressure threshold range, and the working fluid is transferred from the working fluid circuit 202 to the mass control tank 286.

Figure 7:
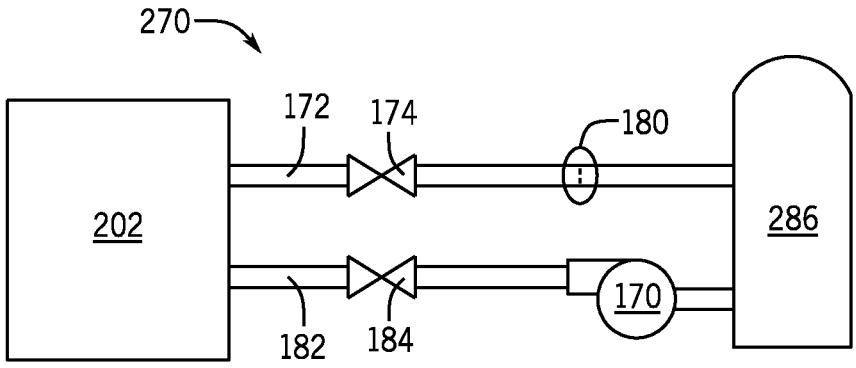
FIG. 7 depicts an exemplary mass management system containing an inventory return line and valve, an inventory supply line and valve, a mass control tank, a transfer pump, and a restricted flow device, according to one or more embodiments disclosed herein.

FIGS. 3 and 7 depict the mass management system 270 containing the mass control tank 286 and the transfer pump 170 connected in series, and may further contain an inventory return line 172 and an inventory return valve 174 and an inventory supply line 182 and an inventory supply valve 184, as described in one or more embodiments herein. The inventory return line 172 may be fluidly coupled to the low pressure side of the working fluid circuit 202 and configured to transfer the working fluid from the working fluid circuit 202. The mass control tank 286 may be fluidly coupled to the inventory return line 172 and configured to receive, store, and dispense the working fluid. The mass management system 270 may also contain the transfer pump 170 fluidly coupled to the mass control tank 286 and configured to transfer the working fluid from the mass control tank 286 to the working fluid circuit 202. The inventory supply line 182 may be fluidly coupled to the low pressure side of the working fluid circuit 202 and configured to transfer the working fluid into the working fluid circuit 202.

The inventory return line 172 may be fluidly coupled to and between the mass control tank 286 and the low pressure side of the working fluid circuit 202, and the inventory return line 172 may be coupled to the working fluid circuit 202 at a point downstream of the condenser 274. The mass management system 270 further contains the inventory return valve 174 fluidly coupled to the inventory return line 172 and configured to control the rate of the working fluid flowing from the low pressure side of the working fluid circuit 202, through the inventory return line 172, and into the mass control tank 286. The inventory supply line 182 may be fluidly coupled to and between the transfer pump 170 and the low pressure side of the working fluid circuit 202 upstream of the system pump, such as the turbopump 260 and/or the start pump 280. Also, the inventory supply valve 184 may be fluidly coupled to the inventory supply line 182 and configured to control the rate of the working fluid flowing from the mass control tank 286, through the inventory supply line 182, and into the low pressure side of the working fluid circuit 202.

In other embodiments, the mass management system 270 may further contain a restricted flow device fluidly coupled within the inventory return line 172 and disposed between the inventory return valve 174 and the mass control tank 286, as depicted in FIG. 7. The restricted flow device 180 may be configured to reduce a flowrate of the working fluid flowing from the inventory return valve 174 towards the mass control tank 286. The restricted flow device 180 may be selected from a restriction orifice device, a critical flow device, a restriction orifice plate, a baffle, a tapering or narrowing line, a control valve, derivatives thereof, or combinations thereof. In some exemplary configurations of the mass management system 270, if the inventory return valve 174 is an isolation shut-off valve, then the restricted flow device 180 may be fluidly coupled within the inventory return line 172 and utilized to reduce the flowrate of the working fluid entering into the mass control tank 286.

In some embodiments, the mass management system 270 further contains the inventory return valve 174 and the inventory supply valve 184. The inventory return valve 174 may be fluidly coupled to the inventory return line 172 and configured to control the rate of the working fluid flowing from the low pressure side of the working fluid circuit 202, through the inventory return line 172, and into the mass control tank 286. The inventory supply valve 184 may be fluidly coupled to the inventory supply line 182 and configured to control the rate of the working fluid flowing from the mass control tank 286, through the inventory supply line 182, and into the low pressure side of the working fluid circuit 202.

In other embodiments disclosed herein, a method for transferring the working fluid between the mass management system 270 and the working fluid circuit 202 is provided herein. In some examples, the method may be utilized by the mass management system 270 and the working fluid circuit 202, as depicted in FIGS. 3 and 7. The method includes providing the inventory return valve 174 in a closed position and the inventory supply valve 184 in a closed position and circulating the working fluid within the working fluid circuit 202. The method further includes providing a high pressure in the high pressure side of the working fluid circuit 202 within a high pressure threshold range and providing a low pressure in the low pressure side of the working fluid circuit 202 within a low pressure threshold range. Also, the method includes monitoring the low pressure via a process control system 204 operatively connected to the working fluid circuit 202 and detecting an undesirable value of the low pressure via the process control system 204, wherein the undesirable value is less than or greater than the low pressure threshold range. The method further includes adjusting the inventory return valve 174 or the inventory supply valve 184 to transfer the working fluid between the working fluid circuit 202 and the mass control tank 286, detecting a desirable value of the low pressure via the process control system 204, wherein the desirable value is within the low pressure threshold range, and adjusting the inventory return valve 174 or the inventory supply valve 184 to the closed position.

In some examples, the method includes determining the undesirable value of the low pressure is greater than the low pressure threshold range and adjusting the inventory return valve 174 to transfer the working fluid from the working fluid circuit 202, through the inventory return line 172, and to the mass control tank 286. In other examples, the method includes determining the undesirable value of the low pressure is less than the low pressure threshold range and adjusting the inventory supply valve 184 to transfer the working fluid from the mass control tank 286, through the inventory supply line 182, and to the working fluid circuit 202. The method generally includes pressurizing the inventory supply line 182 with the transfer pump 170 to a transfer pressure within the low pressure threshold range. In some examples, the method includes adjusting the tank transfer valve 142 to transfer the working fluid by modulating the tank transfer valve 142. In other examples, the method includes modulating the system transfer valve 144 while transferring the working fluid between the working fluid circuit 202 and the mass control tank 286.

In some examples, the undesirable value is less than the low pressure threshold range; therefore, the working fluid may be transferred from the mass control tank 286 to the low pressure side of the working fluid circuit 202 to increase the pressure and mass of the working fluid in the working fluid circuit 202. Alternatively, in other examples, the undesirable value is greater than the low pressure threshold range, and the working fluid may be transferred from the working fluid circuit 202 to the mass control tank 286. Generally, the low pressure may be within the low pressure threshold range from about 4 MPa to about 14 MPa, and the high pressure may be within the high pressure threshold range from about 15 MPa to about 30 MPa.

Figure 8:
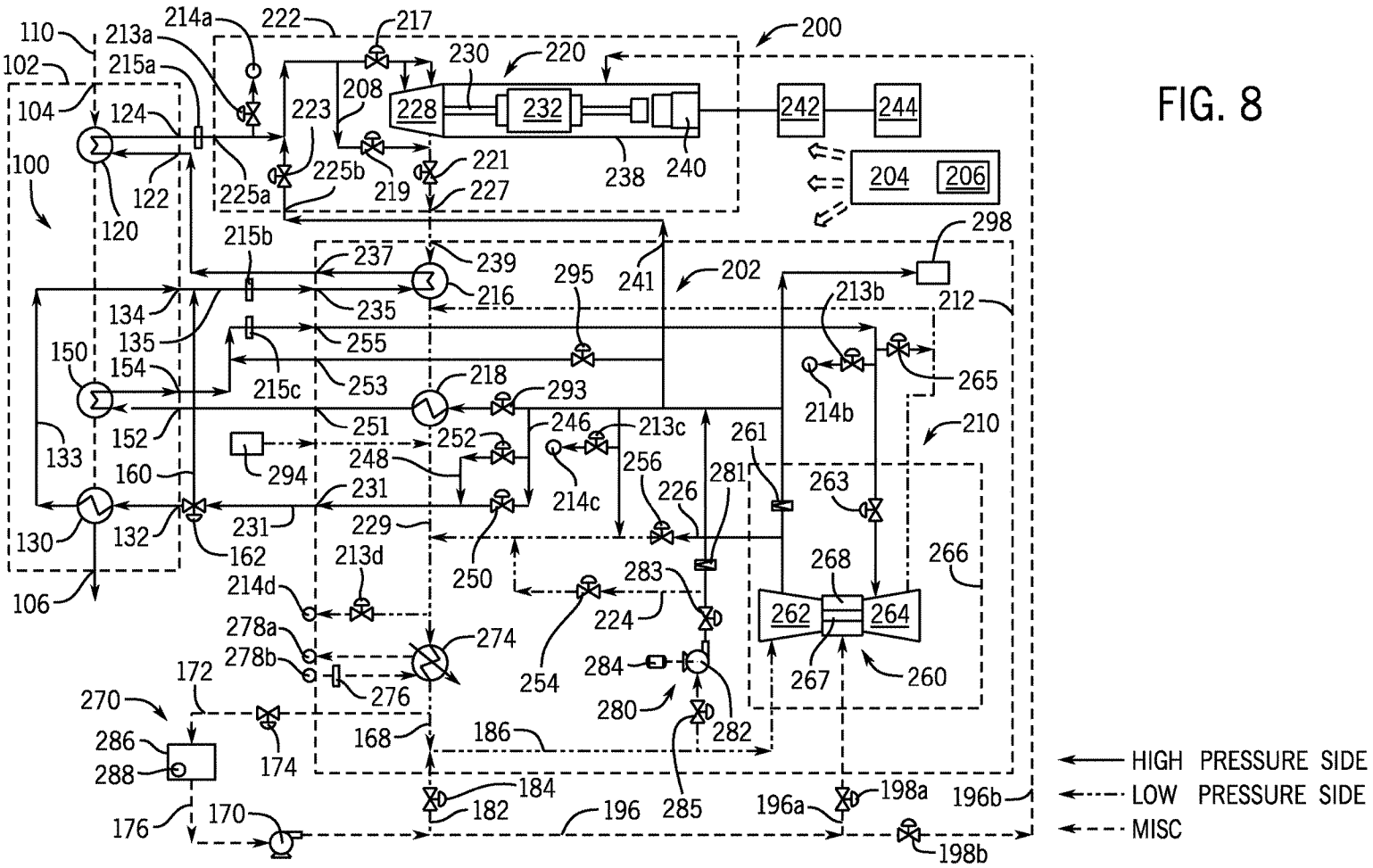
FIG. 8 depicts another exemplary heat engine system containing an exemplary mass management system, according to one or more embodiments disclosed herein.

FIG. 8 depicts an exemplary heat engine system 200 that contains a process system 210 and the power generation system 220 fluidly coupled to and in thermal communication with the waste heat system 100 via a working fluid circuit 202, as described in one or more embodiments herein. The heat engine system 200 may be referred to as a thermal engine system, an electrical generation system, a waste heat or other heat recovery system, and/or a thermal to electrical energy system, as described in one or more embodiments herein. The heat engine system 200 is generally configured to encompass one or more elements of a Rankine cycle, a derivative of a Rankine cycle, or another thermodynamic cycle for generating electrical energy from a wide range of thermal sources. The heat engine system 200 depicted in FIG. 8 and the heat engine systems 90 of FIGS. 1-3 share many common components. The heat engine system 200 generally contains the same components as well as additional components as the heat engine systems 90. In one embodiment, the mass management system 270 of the heat engine system 200 is depicted in FIG. 8 as the same or substantially similar as the mass management system 270 of the heat engine system 90 depicted in FIG. 3, as well as the mass management system 270 depicted in FIG. 7. However, in other embodiments, the mass management systems 270 depicted in FIGS. 1, 2, and 4-6 may also be utilized as the mass management system 270 of the heat engine system 200. It should be noted that like numerals shown in the Figures and discussed herein represent like components throughout the multiple embodiments disclosed herein.

In embodiments described herein, heat engine systems 90, 200 are provided and contain a working fluid circuit 202 having a high pressure side and a low pressure side and containing a working fluid. The working fluid may contain carbon dioxide and at least a portion of the working fluid may be in a supercritical state. The heat engine systems 90, 200 also contain at least one heat exchanger, such as heat exchangers 120, 130, and/or 150, fluidly coupled to and in thermal communication with the high pressure side of the working fluid circuit 202, configured to be fluidly coupled to and in thermal communication with a heat source 110, and configured to transfer thermal energy from the heat source 110 to the working fluid within the high pressure side. The heat engine systems 90, 200 further contain a power turbine 228 or other expander, fluidly coupled to the working fluid circuit 202 and disposed between the high pressure side and the low pressure side. The power turbine 228 may be configured to convert a pressure drop in the working fluid to mechanical energy. The heat engine systems 90, 200 also have the driveshaft 230 coupled to the power turbine 228 and configured to drive a device with the mechanical energy. Throughout various embodiments, the device may be an electrical generator or alternator, a pump or compressor, as well as other types of equipment or components configured to receive and transform work (e.g., the mechanical energy) into other useful energy.

The heat engine systems 90, 200 may contain at least one system pump (e.g., the start pump 280, the turbopump 260, or both) fluidly coupled to the working fluid circuit 202 between the low pressure side and the high pressure side of the working fluid circuit 202 and configured to circulate the working fluid through the working fluid circuit 202. In another embodiment, the heat engine systems 90, 200 contain the turbopump 260 that has a pump portion 262 coupled to an expander or the drive turbine 264 as well as a bearing housing 268 that completely, substantially, or partially encompasses or otherwise encloses bearings. The pump portion 262 may be fluidly coupled to the working fluid circuit 202 between the low pressure side and the high pressure side and may be configured to circulate the working fluid through the working fluid circuit 202. The drive turbine 264, or other expander, may be fluidly coupled to the working fluid circuit 202 between the low pressure side and the high pressure side and may be configured to drive the pump portion 262 by mechanical energy generated by the expansion of the working fluid.

The heat engine systems 90, 200 further contain at least one recuperator, such as recuperators 216 and 218, fluidly coupled to the working fluid circuit 202 operative to transfer thermal energy between the high pressure side and the low pressure side of the working fluid circuit 202. The heat engine systems 90, 200 also contain the condenser 274 or other cooler in thermal communication with the working fluid in the low pressure side of the working fluid circuit 202 and configured to remove thermal energy from the working fluid in the low pressure side of the working fluid circuit 202. The cooler or the condenser 274 may be configured to control a temperature of the working fluid in the low pressure side of the working fluid circuit 202 by transferring thermal energy from the working fluid in the low pressure side to a cooling loop disposed outside of the working fluid circuit 202. The cooling loop may be fluidly coupled to the heat engine system 200 by a cooling fluid return 278*a* and a cooling fluid supply 278*b*, as depicted in FIG. 8.

The heat engine systems 90, 200 also contain the mass management system (MMS) 270 fluidly coupled to the working fluid circuit 202. The mass management system 270 contains the mass control tank 286 fluidly coupled to the low pressure side of the working fluid circuit 202 and configured to receive, store, and deliver the working fluid. For example, the mass control tank 286 may be configured to receive the working fluid from the working fluid circuit 202, configured to store the working fluid for subsequent use, and configured to deliver the working fluid into the working fluid circuit 202. The mass management system 270 also contains the transfer pump 170 fluidly coupled to the mass control tank 286 and configured to transfer the working fluid from the mass control tank 286 to the low pressure side of the working fluid circuit 202 by an inventory supply line 182.

In some examples, the mass control tank 286 may be a cryogenic storage vessel. The mass control tank 286 or the cryogenic storage vessel may have an internal pressure within a range from about 10 psig (pounds per square inch gauge; approximately 69 kPa) to about 800 psig (approximately 5516 kPa), more narrowly within a range from about 50 psig (approximately 345 kPa) to about 500 psig (approximately 3447 kPa), more narrowly within a range from about 100 psig (approximately 689 kPa) to about 450 psig (approximately 3103 kPa), and more narrowly within a range from about 200 psig (approximately 1379 kPa) to about 400 psig (approximately 2758 kPa), for example, about 300 psig (approximately 2068 kPa). Generally, during steady operation of the heat engine systems 90, 200, the high pressure side of the working fluid circuit 202 contains the working fluid in a supercritical state and the low pressure side of the working fluid circuit 202 contains the working fluid in a subcritical state.

The heat engine systems 90, 200 further contain the inventory return line 172 fluidly coupled to and between the mass control tank 286 and the low pressure side of the working fluid circuit 202, such as downstream of the condenser 274. As depicted in FIGS. 1-3 and 8, a fluid line 168 may be fluidly coupled with and extend from the outlet of the condenser 274, and the inventory return line 172 may be fluidly coupled with and extend from the fluid line 168 to the mass control tank 286. The inventory return line 172 generally contains at least one valve, such as an inventory return valve 174, configured to control the flow of the working fluid being transferred from the low pressure side of the working fluid circuit 202 and to the mass control tank 286. An inventory line 176 may be fluidly coupled to and between the mass control tank 286 and the transfer pump 170. The inventory line 176 may be configured to transfer the working fluid contained within the mass control tank 286 to the transfer pump 170. The inventory supply line 182 may be fluidly coupled to and between the transfer pump 170 and the low pressure side of the working fluid circuit 202 upstream of one or more of the system pumps, such as the pump portion 282 of the start pump 280 and the pump portion 262 of the turbopump 260.

Also, as depicted in FIGS. 1-3 and 8, the fluid line 186 may be fluidly coupled with and disposed between a junction point of both the inventory supply line 182 and the fluid line 168 and extend to the pump portion 282 of the start pump 280 and/or the pump portion 262 of the turbopump 260. The inventory supply line 182 generally contains at least one valve, such as an inventory supply valve 184, configured to control the flow of the working fluid from the mass control tank 286, through the transfer pump 170, and to the low pressure side of the working fluid circuit 202.

In some embodiments, the transfer pump 170 may also be configured to transfer the working fluid from the mass control tank 286 to the bearing housings 238, 268 that completely, substantially, or partially encompass or otherwise enclose bearings contained within a system component, as depicted in FIG. 8. The heat engine system 200 further contains bearing gas supply lines 196, 196*a*, 196*b* fluidly coupled to and between the transfer pump 170 and the bearing housing 238, 268. The bearing gas supply lines 196, 196*a*, 196*b* generally contain at least one valve, such as bearing gas supply valves 198*a*, 198*b*, configured to control the flow of the working fluid from the mass control tank 286, through the transfer pump 170, and to the bearing housing 238, 268. In various examples, the system component may be a turbopump, a turbocompressor, a turboalternator, a power generation system, other turbomachinery, and/or other bearing-containing devices 194 (as depicted in FIGS. 1-3). In some examples, the system component may be the system pump, such as the turbopump 260 containing the bearing housing 268. In other examples, the system component may be the power generation system 220 that contains the expander or the power turbine 228, the power generator 240, and the bearing housing 238.

The mass control tank 286 and the working fluid circuit 202 share the working fluid (e.g., carbon dioxide)—such that the mass control tank 286 may receive, store, and disperse the working fluid during various operational steps of the heat engine system 90. In one embodiment, the transfer pump 170 may be utilized to conduct inventory control by removing working fluid from the working fluid circuit 202, storing working fluid, and/or adding working fluid into the working fluid circuit 202. In another embodiment, the transfer pump 170 may be utilized during a startup process to transfer or otherwise deliver the working fluid—as a cooling agent—from the mass control tank 286 to bearings contained within the bearing housing 268 of the turbopump 260, the bearing housing 238 of the power generation system 220, and/or other system components containing bearings (e.g., rotary equipment or turbo machinery).

Exemplary structures of the bearing housing 238 or 268 may completely or substantially encompass or enclose the bearings as well as all or part of turbines, generators, pumps, driveshafts, gearboxes, or other components shown or not shown for heat engine system 90. The bearing housing 238 or 268 may completely or partially include structures, chambers, cases, housings, such as turbine housings, generator housings, driveshaft housings, driveshafts that contain bearings, gearbox housings, derivatives thereof, or combinations thereof. FIG. 8 depicts the bearing housing 238 containing all or a portion of the power turbine 228, the power generator 240, the driveshaft 230, and the gearbox 232 of the power generation system 220. In some examples, the housing of the power turbine 228 is coupled to and/or forms a portion of the bearing housing 238. Similarly, the bearing housing 268 contains all or a portion of the drive turbine 264, the pump portion 262, and the driveshaft 267 of the turbopump 260. In other examples, the housing of the drive turbine 264 and the housing of the pump portion 262 may be independently coupled to and/or form portions of the bearing housing 268.

In one or more embodiments disclosed herein, at least one bearing gas supply line 196 may be fluidly coupled to and disposed between the transfer pump 170 and at least one bearing housing (e.g., bearing housing 238 or 268) substantially encompassing, enclosing, or otherwise surrounding the bearings of one or more system components. The bearing gas supply line 196 may have or otherwise split into multiple spurs or segments of fluid lines, such as bearing gas supply lines 196*a* and 196*b*, which each independently extends to a specified bearing housing 238 or 268, respectively, as illustrated in FIG. 8. In one example, the bearing gas supply line 196*a* may be fluidly coupled to and disposed between the transfer pump 170 and the bearing housing 268 within the turbopump 260. In another example, the bearing gas supply line 196*b* may be fluidly coupled to and disposed between the transfer pump 170 and the bearing housing 238 within the power generation system 220.

FIG. 8 further depicts a bearing gas supply valve 198*a* fluidly coupled to and disposed along the bearing gas supply line 196*a*. The bearing gas supply valve 198*a* may be utilized to control the flow of the working fluid from the transfer pump 170 to the bearing housing 268 within the turbopump 260. Similarly, a bearing gas supply valve 198*b* may be fluidly coupled to and disposed along the bearing gas supply line 196*b*. The bearing gas supply valve 198*b* may be utilized to control the flow of the working fluid from the transfer pump 170 to the bearing housing 238 within the power generation system 220.

In some examples, the heat engine systems 90, 200 further contain a variable frequency drive coupled to the system pump and configured to control mass flowrate or temperature of the working fluid within the high pressure side of the working fluid circuit 202. In other examples, the heat engine systems 90, 200 may also contain a generator or an alternator, such as the power generator 240, coupled to the expander or the power turbine 228 by the driveshaft 230 and configured to convert the mechanical energy into electrical energy. In one example, the system pump may be coupled to the expander or the power turbine 228 by the driveshaft 230 and configured to be driven by the mechanical energy for circulating the working fluid through the working fluid circuit 202. In another example, another pump portion may be coupled to the expander or the power turbine 228 by the driveshaft 230 to form a turbopump, and the pump portion may be configured to be driven by the mechanical energy. In yet another example, an independent turbopump, such as the turbopump 260, may be coupled to the working fluid circuit 202. The turbopump 260 may contain the pump portion 262 coupled to another expander, such as the drive turbine 264, different than the system pump or the power turbine 228. In many examples, the expanders are both turbines, such as the drive turbine 264 and the power turbine 228. Generally, the pump portion 262 of the turbopump 260 may be fluidly coupled to the working fluid circuit 202 between the low pressure side and the high pressure side of the working fluid circuit 202 and may be configured to circulate the working fluid through the working fluid circuit 202. Also, the drive turbine 264 of the turbopump 260 may be fluidly coupled to the working fluid circuit 202 between the low pressure side and the high pressure side of the working fluid circuit 202 and may be configured to drive the pump portion 262 by mechanical energy generated by the expansion of the working fluid.

In other embodiments described herein, a method for transforming between types of energy with the heat engine systems 90, 200 is provided and includes circulating a working fluid within the working fluid circuit 202 by a system pump, wherein the working fluid circuit 202 has a high pressure side and a low pressure side and at least a portion of the working fluid may be in a supercritical state. In many examples and during various periods of the generation or power cycle, the high pressure side of the working fluid circuit 202 may contain the working fluid in a supercritical state while the low pressure side of the working fluid circuit 202 may contain the working fluid in a subcritical state and/or a supercritical state. The method further includes transferring thermal energy from the heat source 110 to the working fluid by the heat exchanger 120 fluidly coupled to and in thermal communication with the heat source 110 and the high pressure side of the working fluid circuit 202 and flowing the working fluid into an expander and converting the thermal energy from the working fluid to mechanical energy of the expander or the power turbine 228. In some examples, the method includes converting the mechanical energy into electrical energy by a power generator 240 coupled to the expander or the power turbine 228.

The method also includes transferring, passing, or otherwise flowing a portion of the working fluid from the low pressure side to the mass control tank 286 fluidly coupled to the low pressure side of the working fluid circuit 202 and configured to receive, store, and deliver the working fluid. The method further includes flowing or transferring the working fluid from the mass control tank 286, through the transfer pump 170, and to a point within the low pressure side of the working fluid circuit 202 upstream of the system pump, as well as flowing or transferring the working fluid from the mass control tank 286, through the transfer pump 170, and to a bearing housing 238, 268 that completely, substantially, or partially encompasses or otherwise encloses bearings contained within a system component. The bearings disposed within the bearing housing 238, 268 are exposed to and cooled by the working fluid. Therefore, the transfer pump 170 may be fluidly coupled to and disposed downstream of the mass control tank 286, fluidly coupled to and upstream of the point within the low pressure side of the working fluid circuit 202, and fluidly coupled to and upstream of the bearing housing 238, 268.

In some embodiments, the method includes adjusting at least one valve, such as an inventory return valve 174, to control the rate of the working fluid flowing from the low pressure side of the working fluid circuit 202, through an inventory return line 172, to the mass control tank 286. In other embodiments, the method includes adjusting at least one valve, such as the inventory supply valve 184, to control the rate of the working fluid flowing from the transfer pump 170, through the inventory supply line 182, to the point within the low pressure side of the working fluid circuit 202. In other embodiments, the method includes adjusting at least one valve, such as bearing gas supply valves 198*a*, 198*b*, to control the rate of the working fluid flowing from the transfer pump 170, through a bearing gas supply line 196, 196*a*, 196*b*, to the bearing housing 238, 268.

In one or more embodiments described herein, the heat engine system 200 for transforming thermal energy into mechanical energy and/or electrical energy provides the working fluid circuit 202 containing the working fluid and having a high pressure side and a low pressure side, wherein at least a portion of the working fluid contains carbon dioxide in a supercritical state. In many examples, the working fluid contains carbon dioxide and at least a portion of the carbon dioxide is in a supercritical state. The heat engine system 200 also has the heat exchanger 120 fluidly coupled to and in thermal communication with the high pressure side of the working fluid circuit 202, configured to be fluidly coupled to and in thermal communication with the heat source stream 110, and configured to transfer thermal energy from the heat source stream 110 to the working fluid within the working fluid circuit 202. The heat exchanger 120 may be fluidly coupled to the working fluid circuit 202 upstream of the power turbine 228 and downstream of the recuperator 216.

The heat engine system 200 further contains an expander or a power turbine 228 disposed between the high pressure side and the low pressure side of the working fluid circuit 202, fluidly coupled to and in thermal communication with the working fluid, and configured to convert thermal energy to mechanical energy by a pressure drop in the working fluid flowing between the high and the low pressure sides of the working fluid circuit 202. The heat engine system 200 also may contain a power generator 240 and a power outlet 242. The power generator 240 may be coupled to the power turbine 228 and configured to convert the mechanical energy into electrical energy. The power outlet 242 may be electrically coupled to the power generator 240 and configured to transfer the electrical energy from the power generator 240 to the electrical grid 244.

The heat engine system 200 further contains the turbopump 260 which has a drive turbine 264 and a pump portion 262. The pump portion 262 of the turbopump 260 may be fluidly coupled to the low pressure side of the working fluid circuit 202 by an inlet configured to receive the working fluid from the low pressure side of the working fluid circuit 202, fluidly coupled to the high pressure side of the working fluid circuit 202 by an outlet configured to release the working fluid into the high pressure side of the working fluid circuit 202, and configured to circulate the working fluid within the working fluid circuit 202. The drive turbine 264 of the turbopump 260 may be fluidly coupled to the high pressure side of the working fluid circuit 202 by an inlet configured to receive the working fluid from the high pressure side of the working fluid circuit 202, fluidly coupled to the low pressure side of the working fluid circuit 202 by an outlet configured to release the working fluid into the low pressure side of the working fluid circuit 202, and configured to rotate the pump portion 262 of the turbopump 260.

In some embodiments, the heat engine system 200 further contains the heat exchanger 150 which is generally fluidly coupled to and in thermal communication with the heat source stream 110 and independently fluidly coupled to and in thermal communication with the high pressure side of the working fluid circuit 202, such that thermal energy may be transferred from the heat source stream 110 to the working fluid. The heat exchanger 150 may be fluidly coupled to the working fluid circuit 202 upstream of the outlet of the pump portion 262 of the turbopump 260 and downstream of the inlet of the drive turbine 264 of the turbopump 260. The turbopump throttle valve 263 may be fluidly coupled to the working fluid circuit 202 downstream of the heat exchanger 150 and upstream of the inlet of the drive turbine 264 of the turbopump 260. The working fluid containing the absorbed thermal energy flows from the heat exchanger 150 to the drive turbine 264 of the turbopump 260 via the turbopump throttle valve 263. Therefore, in some embodiments, the turbopump throttle valve 263 may be utilized to control the flowrate of the heated working fluid flowing from the heat exchanger 150 to the drive turbine 264 of the turbopump 260.

In some embodiments, the recuperator 216 may be fluidly coupled to the working fluid circuit 202 and configured to transfer thermal energy from the working fluid within the low pressure side to the working fluid within the high pressure side of the working fluid circuit 202. In other embodiments, a recuperator 218 may be fluidly coupled to the working fluid circuit 202 downstream of the outlet of the pump portion 262 of the turbopump 260 and upstream of the heat exchanger 150 and configured to transfer thermal energy from the working fluid within the low pressure side to the working fluid within the high pressure side of the working fluid circuit 202.

FIG. 8 further depicts that the waste heat system 100 of the heat engine system 200 contains three heat exchangers (e.g., the heat exchangers 120, 130, and 150) fluidly coupled to the high pressure side of the working fluid circuit 202 and in thermal communication with the heat source stream 110. Such thermal communication provides the transfer of thermal energy from the heat source stream 110 to the working fluid flowing throughout the working fluid circuit 202. In one or more embodiments disclosed herein, two, three, or more heat exchangers may be fluidly coupled to and in thermal communication with the working fluid circuit 202, such as a primary heat exchanger, a secondary heat exchanger, a tertiary heat exchanger, respectively the heat exchangers 120, 150, and 130, and/or an optional quaternary heat exchanger (not shown). For example, the heat exchanger 120 may be the primary heat exchanger fluidly coupled to the working fluid circuit 202 upstream of an inlet of the power turbine 228, the heat exchanger 150 may be the secondary heat exchanger fluidly coupled to the working fluid circuit 202 upstream of an inlet of the drive turbine 264 of the turbine pump 260, and the heat exchanger 130 may be the tertiary heat exchanger fluidly coupled to the working fluid circuit 202 upstream of an inlet of the heat exchanger 120.

The waste heat system 100 also contains an inlet 104 for receiving the heat source stream 110 and an outlet 106 for passing the heat source stream 110 out of the waste heat system 100. The heat source stream 110 flows through and from the inlet 104, through the heat exchanger 120, through one or more additional heat exchangers, if fluidly coupled to the heat source stream 110, and to and through the outlet 106. In some examples, the heat source stream 110 flows through and from the inlet 104, through the heat exchangers 120, 150, and 130, respectively, and to and through the outlet 106. The heat source stream 110 may be routed to flow through the heat exchangers 120, 130, 150, and/or additional heat exchangers in other desired orders.

The heat source stream 110 may be a waste heat stream such as, but not limited to, gas turbine exhaust stream, industrial process exhaust stream, or other combustion product exhaust streams, such as furnace or boiler exhaust streams. The heat source stream 110 may be at a temperature within a range from about 100° C. to about 1,000° C., or greater than 1,000° C., and in some examples, within a range from about 200° C. to about 800° C., more narrowly within a range from about 300° C. to about 600° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

In some embodiments, the types of working fluid that may be circulated, flowed, or otherwise utilized in the working fluid circuit 202 of the heat engine system 200 include carbon oxides, hydrocarbons, alcohols, ketones, halogenated hydrocarbons, ammonia, amines, aqueous, or combinations thereof. Exemplary working fluids that may be utilized in the heat engine system 200 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid the working fluid circulated, flowed, or otherwise utilized in the working fluid circuit 202 of the heat engine system 200, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typically used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side and a low pressure side and contains a working fluid circulated within the working fluid circuit 202. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the working fluid circuit 202, the heat engine systems 90, 200, or thermodynamic cycle. In one or more embodiments, the working fluid is in a supercritical state over certain portions of the working fluid circuit 202 of the heat engine systems 90, 200 (e.g., a high pressure side) and in a subcritical state over other portions of the working fluid circuit 202 of the heat engine system 200 (e.g., a low pressure side). FIG. 8 depicts the high and low pressure sides of the working fluid circuit 202 of the heat engine system 200 by representing the high pressure side with "—" and the low pressure side with "-·-·-·" as described in one or more embodiments. In other embodiments, the entire thermodynamic cycle may be operated such that the working fluid is maintained in either a supercritical or subcritical state throughout the entire working fluid circuit 202 of the heat engine systems 90, 200.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range (e.g., a high pressure threshold range) from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less or about 10 MPa or less. In some examples, the low pressure side of the working fluid circuit 202 may have a pressure within a range from about 4 MPa to about 14 MPa, more narrowly within a range (e.g., a low pressure threshold range) from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa while the low pressure side of the working fluid circuit 202 may have a pressure within a range from about 8 MPa to about 11 MPa, and more narrowly within a range from about 10.3 MPa to about 11 MPa.

The heat engine system 200 further contains the power turbine 228 disposed between the high pressure side and the low pressure side of the working fluid circuit 202, disposed downstream of the heat exchanger 120, and fluidly coupled to and in thermal communication with the working fluid. The power turbine 228 is configured to convert a pressure drop in the working fluid to mechanical energy whereby the absorbed thermal energy of the working fluid is transformed to mechanical energy of the power turbine 228. Therefore, the power turbine 228 is an expander capable of transforming a pressurized fluid into mechanical energy, generally, transforming high temperature and pressure fluid into mechanical energy, such as rotating a driveshaft.

The power turbine 228 may contain or be a turbine, a turbo, an expander, or another device for receiving and expanding the working fluid discharged from the heat exchanger 120. The power turbine 228 may have an axial construction or radial construction and may be a single-staged device or a multi-staged device. Exemplary turbines that may be utilized in power turbine 228 include an expander or expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 228.

The power turbine 228 is generally coupled to the power generator 240 by the driveshaft 230. A gearbox 232 is generally disposed between the power turbine 228 and the power generator 240 and adjacent or encompassing the driveshaft 230. The driveshaft 230 may be a single piece or contain two or more pieces coupled together. In one example, a first segment of the driveshaft 230 extends from the power turbine 228 to the gearbox 232, a second segment of the driveshaft 230 extends from the gearbox 232 to the power generator 240, and multiple gears are disposed between and coupled to the two segments of the driveshaft 230 within the gearbox 232.

In some configurations, the heat engine system 200 also provides for the delivery of a portion of the working fluid, seal gas, bearing gas, air, or other gas into a chamber or housing, such as bearing housing 238 of the power generator 240 for purposes of cooling one or more parts of the power turbine 228. In other configurations, the driveshaft 230 includes a seal assembly (not shown) designed to prevent or capture any working fluid leakage from the power turbine 228. Additionally, a working fluid recycle system may be implemented along with the seal assembly to recycle seal gas back into the working fluid circuit 202 of the heat engine system 200.

The power generator 240 may be a generator, an alternator (e.g., permanent magnet alternator), or other device for generating electrical energy, such as transforming mechanical energy from the driveshaft 230 and the power turbine 228 to electrical energy. A power outlet 242 is electrically coupled to the power generator 240 and configured to transfer the generated electrical energy from the power generator 240 and to an electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operably connected to the electrical grid 244 via the power outlet 242. In another example, the power generator 240 is an alternator and is electrically and operably connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resistors, storage devices, and other power electronic components and devices. In other embodiments, the power generator 240 may contain, be coupled with, or be other types of load receiving equipment, such as other types of electrical generation equipment, rotating equipment, a gearbox (e.g., gearbox 232), or other device configured to modify or convert the shaft work created by the power turbine 228. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 200 also provides for the delivery of a portion of the working fluid into a chamber or housing of the power turbine 228 for purposes of cooling one or more parts of the power turbine 228. In one embodiment, due to the potential need for dynamic pressure balancing within the power generator 240, the selection of the site within the heat engine system 200 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet of the power turbine 228. The working fluid is conditioned to be at a desired temperature and pressure prior to being introduced into the power turbine 228. A portion of the working fluid, such as the spent working fluid, exits the power turbine 228 at an outlet of the power turbine 228 and is directed to one or more heat exchangers or recuperators, such as recuperators 216 and 218. The recuperators 216 and 218 may be fluidly coupled to the working fluid circuit 202 in series with each other. The recuperators 216 and 218 are operative to transfer thermal energy between the high pressure side and the low pressure side of the working fluid circuit 202.

In one embodiment, the recuperator 216 may be fluidly coupled to the low pressure side of the working fluid circuit 202, disposed downstream of a working fluid outlet on the power turbine 228, and disposed upstream of the recuperator 218 and/or the condenser 274. The recuperator 216 is configured to remove at least a portion of thermal energy from the working fluid discharged from the power turbine 228. In addition, the recuperator 216 is also fluidly coupled to the high pressure side of the working fluid circuit 202, disposed upstream of the heat exchanger 120 and/or a working fluid inlet on the power turbine 228, and disposed downstream of the heat exchanger 130. The recuperator 216 is configured to increase the amount of thermal energy in the working fluid prior to the working fluid being flowed into the heat exchanger 120 and/or the power turbine 228. Therefore, the recuperator 216 is operative to transfer thermal energy between the high pressure side and the low pressure side of the working fluid circuit 202. Generally, the recuperator 216 may be configured to transfer thermal energy from the low pressure side to the high pressure side of the working fluid circuit 202. In some examples, the recuperator 216 may be a heat exchanger configured to cool the low pressurized working fluid discharged or downstream of the power turbine 228 while heating the high pressurized working fluid entering into or upstream of the heat exchanger 120 and/or the power turbine 228.

Similarly, in another embodiment, the recuperator 218 may be fluidly coupled to the low pressure side of the working fluid circuit 202, disposed downstream of a working fluid outlet on the power turbine 228 and/or the recuperator 216, and disposed upstream of the condenser 274. The recuperator 218 is configured to remove at least a portion of thermal energy from the working fluid discharged from the power turbine 228 and/or the recuperator 216. In addition, the recuperator 218 is also fluidly coupled to the high pressure side of the working fluid circuit 202, disposed upstream of the heat exchanger 150 and/or a working fluid inlet on a drive turbine 264 of turbopump 260, and disposed downstream of a working fluid outlet on a pump portion 262 of turbopump 260. The recuperator 218 is configured to increase the amount of thermal energy in the working fluid prior to the working fluid being flowed into the heat exchanger 150 and/or the drive turbine 264. Therefore, the recuperator 218 is operative to transfer thermal energy between the high pressure side and the low pressure side of the working fluid circuit 202. Generally, the recuperator 218 may be configured to transfer thermal energy from the low pressure side to the high pressure side of the working fluid circuit 202. In some examples, the recuperator 218 may be a heat exchanger configured to cool the low pressurized working fluid discharged or downstream of the power turbine 228 and/or the recuperator 216 while heating the high pressurized working fluid entering into or upstream of the heat exchanger 150 and/or the drive turbine 264.

A cooler or a condenser 274 may be fluidly coupled to and in thermal communication with the low pressure side of the working fluid circuit 202 and may be configured or operative to control a temperature of the working fluid in the low pressure side of the working fluid circuit 202. The condenser 274 may be disposed downstream of the recuperators 216 and 218 and upstream of the start pump 280 and the turbopump 260. The condenser 274 receives the cooled working fluid from the recuperator 218 and further cools and/or condenses the working fluid which may be recirculated throughout the working fluid circuit 202. In many examples, the condenser 274 is a cooler and may be configured to control a temperature of the working fluid in the low pressure side of the working fluid circuit 202 by transferring thermal energy from the working fluid in the low pressure side to a cooling loop or system outside of the working fluid circuit 202.

A cooling media or fluid is generally utilized in the cooling loop or system by the condenser 274 for cooling the working fluid and removing thermal energy outside of the working fluid circuit 202. The cooling media or fluid flows through, over, or around while in thermal communication with the condenser 274. Thermal energy in the working fluid is transferred to the cooling fluid via the condenser 274. Therefore, the cooling fluid is in thermal communication with the working fluid circuit 202, but not fluidly coupled to the working fluid circuit 202. The condenser 274 may be fluidly coupled to the working fluid circuit 202 and independently fluidly coupled to the cooling fluid. The cooling fluid may contain one or multiple compounds and may be in one or multiple states of matter. The cooling fluid may be a media or fluid in a gaseous state, a liquid state, a subcritical state, a supercritical state, a suspension, a solution, derivatives thereof, or combinations thereof.

In many examples, the condenser 274 is generally fluidly coupled to a cooling loop or system (not shown) that receives the cooling fluid from a cooling fluid return **278*a* and returns the warmed cooling fluid to the cooling loop or system via a cooling fluid supply 278*b*. The cooling fluid may be water, carbon dioxide, or other aqueous and/or organic fluids (e.g., alcohols and/or glycols), air or other gases, or various mixtures thereof that is maintained at a lower temperature than the temperature of the working fluid. In other examples, the cooling media or fluid contains air or another gas exposed to the condenser 274, such as an air steam blown by a motorized fan or blower. A filter 276 may be disposed along and in fluid communication with the cooling fluid line at a point downstream of the cooling fluid supply 278*b* and upstream of the condenser 274. In some examples, the filter 276 may be fluidly coupled to the cooling fluid line within the process system 210**.

The heat engine system 200 further contains several pumps, such as the turbopump 260 and the start pump 280, disposed within the working fluid circuit 202 and fluidly coupled between the low pressure side and the high pressure side of the working fluid circuit 202. The turbopump 260 and the start pump 280 are operative to circulate the working fluid throughout the working fluid circuit 202. The start pump 280 is generally a motorized pump and may be utilized to initially pressurize and circulate the working fluid in the working fluid circuit 202. Once a predetermined pressure, temperature, and/or flowrate of the working fluid is obtained within the working fluid circuit 202, the start pump 280 may be taken off line, idled, or turned off and the turbopump 260 may be utilized to circulate the working fluid during the electricity generation process. The working fluid enters each of the turbopump 260 and the start pump 280 from the low pressure side of the working fluid circuit 202 and exits each of the turbopump 260 and the start pump 280 from the high pressure side of the working fluid circuit 202.

The start pump 280 may be a motorized pump, such as an electric-motorized pump, a mechanical-motorized pump, or other type of pump. Generally, the start pump 280 may be a variable frequency motorized drive pump and contains a pump portion 282 and a motor-drive portion 284. The motor-drive portion 284 of the start pump 280 contains a motor and a drive including a driveshaft and gears. In some examples, the motor-drive portion 284 has a variable frequency drive, such that the speed of the motor may be regulated by the drive. The pump portion 282 of the start pump 280 is driven by the motor-drive portion 284 coupled thereto. The pump portion 282 has an inlet for receiving the working fluid from the low pressure side of the working fluid circuit 202, such as from the condenser 274. The pump portion 282 has an outlet for releasing the working fluid into the high pressure side of the working fluid circuit 202.

Valves 283 and 285 may be utilized to control the flow of the working fluid passing through the start pump 280. Valve 285 may be fluidly coupled to the low pressure side of the working fluid circuit 202 upstream of the pump portion 282 of the start pump 280 and may be utilized to control the flowrate of the working fluid entering the inlet of the pump portion 282. Valve 283 may be fluidly coupled to the high pressure side of the working fluid circuit 202 downstream of the pump portion 282 of the start pump 280 and may be utilized to control the flowrate of the working fluid exiting the outlet of the pump portion 282.

The turbopump 260 is generally a turbo-drive pump or a turbine-drive pump and utilized to pressurize and circulate the working fluid throughout the working fluid circuit 202. The turbopump 260 contains a pump portion 262 and a drive turbine 264 coupled together by a driveshaft 267 and an optional gearbox (not shown). The drive turbine 264 is configured to rotate the pump portion 262, and the pump portion 262 is configured to circulate the working fluid within the working fluid circuit 202.

The driveshaft 267 may be a single piece or contain two or more pieces coupled together. In one example, a first segment of the driveshaft 267 extends from the drive turbine 264 to the gearbox, a second segment of the driveshaft 230 extends from the gearbox to the pump portion 262, and multiple gears are disposed between and coupled to the two segments of the driveshaft 267 within the gearbox.

The drive turbine 264 of the turbopump 260 is driven by heated working fluid, such as the working fluid flowing from the heat exchanger 150. The drive turbine 264 may be fluidly coupled to the high pressure side of the working fluid circuit 202 by an inlet configured to receive the working fluid from the high pressure side of the working fluid circuit 202, such as flowing from the heat exchanger 150. The drive turbine 264 may be fluidly coupled to the low pressure side of the working fluid circuit 202 by an outlet configured to release the working fluid into the low pressure side of the working fluid circuit 202.

The pump portion 262 of the turbopump 260 is driven by the driveshaft 267 coupled to the drive turbine 264. The pump portion 262 of the turbopump 260 may be fluidly coupled to the low pressure side of the working fluid circuit 202 by an inlet configured to receive the working fluid from the low pressure side of the working fluid circuit 202. The inlet of the pump portion 262 is configured to receive the working fluid from the low pressure side of the working fluid circuit 202, such as from the condenser 274. Also, the pump portion 262 may be fluidly coupled to the high pressure side of the working fluid circuit 202 by an outlet configured to release the working fluid into the high pressure side of the working fluid circuit 202 and circulate the working fluid within the working fluid circuit 202.

In one configuration, the working fluid released from the outlet on the drive turbine 264 is returned into the working fluid circuit 202 downstream of the recuperator 216 and upstream of the recuperator 218. In one or more embodiments, the turbopump 260, including piping and valves, is optionally disposed on a turbopump skid 266, as depicted in FIG. 8. The turbopump skid 266 may be disposed on or adjacent to the main process skid 212.

A bypass valve 265 is generally coupled between and in fluid communication with a fluid line extending from the inlet on the drive turbine 264 with a fluid line extending from the outlet on the drive turbine 264. The bypass valve 265 is generally opened to bypass the turbopump 260 while using the start pump 280 during the initial stages of generating electricity or mechanical power with the heat engine system 200. Once a predetermined pressure and temperature of the working fluid is obtained within the working fluid circuit 202, the bypass valve 265 is closed and the heated working fluid is flowed through the drive turbine 264 to start the turbopump 260.

A turbopump throttle valve 263 may be coupled between and in fluid communication with a fluid line extending from the heat exchanger 150 to the inlet on the drive turbine 264 of the turbopump 260. The turbopump throttle valve 263 is configured to modulate the flow of the heated working fluid into the drive turbine 264 which in turn—may be utilized to adjust the flow of the working fluid throughout the working fluid circuit 202. Additionally, valve 293 may be utilized to provide back pressure for the drive turbine 264 of the turbopump 260, and the valve 295 is generally an attemperator valve utilized by the turbopump 260.

A control valve 261 may be disposed downstream of the outlet of the pump portion 262 of the turbopump 260 and the control valve 281 may be disposed downstream of the outlet of the pump portion 282 of the start pump 280. Control valves 261 and 281 are flow control safety valves and are generally utilized to regulate the directional flow or to prohibit backflow of the working fluid within the working fluid circuit 202. Control valve 261 may be configured to prevent the working fluid from flowing upstream towards or into the outlet of the pump portion 262 of the turbopump 260. Similarly, control valve 281 may be configured to prevent the working fluid from flowing upstream towards or into the outlet of the pump portion 282 of the start pump 280.

The turbopump throttle valve 263 may be fluidly coupled to the working fluid circuit 202 upstream of the inlet of the drive turbine 264 of the turbopump 260 and configured to control a flow of the working fluid flowing into the drive turbine 264. The power turbine bypass valve 219 may be fluidly coupled to the power turbine bypass line 208 and configured to modulate, adjust, or otherwise control the working fluid flowing through the power turbine bypass line 208 for controlling the flowrate of the working fluid entering the power turbine 228.

The power turbine bypass line 208 may be fluidly coupled to the working fluid circuit 202 at a point upstream of an inlet of the power turbine 228 and at a point downstream of an outlet of the power turbine 228. The power turbine bypass line 208 is configured to flow the working fluid around and avoid the power turbine 228 when the power turbine bypass valve 219 is in an opened position. The flowrate and the pressure of the working fluid flowing into the power turbine 228 may be reduced or stopped by adjusting the power turbine bypass valve 219 to the opened position. Alternatively, the flowrate and the pressure of the working fluid flowing into the power turbine 228 may be increased or started by adjusting the power turbine bypass valve 219 to the closed position due to the backpressure formed through the power turbine bypass line 208.

The power turbine bypass valve 219 and the turbopump throttle valve 263 may be independently controlled by the process control system 204 that is communicably connected, wired and/or wirelessly, with the power turbine bypass valve 219, the turbopump throttle valve 263, and other parts of the heat engine system 200. The process control system 204 is operatively connected to the working fluid circuit 202 and a mass management system 270 and is enabled to monitor and control multiple process operation parameters of the heat engine system 200.

In one or more embodiments, the working fluid circuit 202 provides a bypass flowpath for the start pump 280 via the fluid line 224 and a bypass valve 254, as well as a bypass flowpath for the turbopump 260 via the fluid line 226 and a bypass valve 256. One end of the fluid line 224 may be fluidly coupled to an outlet of the pump portion 282 of the start pump 280, and the other end of the fluid line 224 may be fluidly coupled to a fluid line 229. Similarly, one end of a fluid line 226 may be fluidly coupled to an outlet of the pump portion 262 of the turbopump 260, and the other end of the fluid line 226 is coupled to the fluid line 224. The fluid lines 224 and 226 merge together as a single line upstream of coupling to a fluid line 229. The fluid line 229 extends between and fluidly coupled to the recuperator 218 and the condenser 274. The bypass valve 254 may be disposed along the fluid line 224 and fluidly coupled between the low pressure side and the high pressure side of the working fluid circuit 202 when in a closed position. Similarly, the bypass valve 256 may be disposed along the fluid line 226 and fluidly coupled between the low pressure side and the high pressure side of the working fluid circuit 202 when in a closed position.

FIG. 8 further depicts a power turbine throttle valve 250 fluidly coupled to a bypass line 246 on the high pressure side of the working fluid circuit 202 and upstream of the heat exchanger 120, as disclosed by at least one embodiment described herein. The power turbine throttle valve 250 may be fluidly coupled to the bypass line 246 and configured to modulate, adjust, or otherwise control the working fluid flowing through the bypass line 246 for controlling a general coarse flowrate of the working fluid within the working fluid circuit 202. The bypass line 246 may be fluidly coupled to the working fluid circuit 202 at a point upstream of the valve 293 and at a point downstream of the pump portion 282 of the start pump 280 and/or the pump portion 262 of the turbopump 260. Additionally, a power turbine trim valve 252 may be fluidly coupled to a bypass line 248 on the high pressure side of the working fluid circuit 202 and upstream of the heat exchanger 150, as disclosed by another embodiment described herein. The power turbine trim valve 252 may be fluidly coupled to the bypass line 248 and configured to modulate, adjust, or otherwise control the working fluid flowing through the bypass line 248 for controlling a fine flowrate of the working fluid within the working fluid circuit 202. The bypass line 248 may be fluidly coupled to the bypass line 246 at a point upstream of the power turbine throttle valve 250 and at a point downstream of the power turbine throttle valve 250.

The heat engine system 200 further contains a turbopump throttle valve 263 fluidly coupled to the working fluid circuit 202 upstream of the inlet of the drive turbine 264 of the turbopump 260 and configured to modulate a flow of the working fluid flowing into the drive turbine 264, a power turbine bypass line 208 fluidly coupled to the working fluid circuit 202 upstream of an inlet of the power turbine 228, fluidly coupled to the working fluid circuit 202 downstream of an outlet of the power turbine 228, and configured to flow the working fluid around and avoid the power turbine 228, a power turbine bypass valve 219 fluidly coupled to the power turbine bypass line 208 and configured to modulate a flow of the working fluid flowing through the power turbine bypass line 208 for controlling the flowrate of the working fluid entering the power turbine 228, and a process control system 204 operatively connected to the heat engine system 90, wherein the process control system 204 is configured to adjust the turbopump throttle valve 263 and the power turbine bypass valve 219.

A bypass line 160 may be fluidly coupled to a fluid line 131 of the working fluid circuit 202 upstream of the heat exchangers 120, 130, and/or 150 by a bypass valve 162, as illustrated in FIG. 8. The bypass valve 162 may be a solenoid valve, a hydraulic valve, an electric valve, a manual valve, or derivatives thereof. In many examples, the bypass valve 162 is a solenoid valve and configured to be controlled by the process control system 204.

In one or more embodiments, the working fluid circuit 202 provides release valves 213*a*, 213*b*, 213*c*, and 213*d*, as well as release outlets 214*a*, 214*b*, 214*c*, and 214*d*, respectively in fluid communication with each other. Generally, the release valves 213*a*, 213*b*, 213*c*, and 213*d* remain closed during the electricity generation process, but may be configured to automatically open to release an over-pressure at a predetermined value within the working fluid. Once the working fluid flows through the valve 213*a*, 213*b*, 213*c*, or 213*d*, the working fluid is vented through the respective release outlet 214*a*, 214*b*, 214*c*, or 214*d*. The release outlets 214*a*, 214*b*, 214*c*, and 214*d* may provide passage of the working fluid into the ambient surrounding atmosphere. Alternatively, the release outlets 214*a*, 214*b*, 214*c*, and 214*d* may provide passage of the working fluid into a recycling or reclamation step that generally includes capturing, condensing, and storing the working fluid.

The release valve 213*a* and the release outlet 214*a* are fluidly coupled to the working fluid circuit 202 at a point disposed between the heat exchanger 120 and the power turbine 228. The release valve 213*b* and the release outlet 214*b* are fluidly coupled to the working fluid circuit 202 at a point disposed between the heat exchanger 150 and the turbo portion 264 of the turbopump 260. The release valve

213*c* and the release outlet 214*c* are fluidly coupled to the working fluid circuit 202 via a bypass line that extends from a point between the valve 293 and the pump portion 262 of the turbopump 260 to a point on the fluid line 226 between the bypass valve 256 and the fluid line 229. The release valve 213*d* and the release outlet 214*d* are fluidly coupled to the working fluid circuit 202 at a point disposed between the recuperator 218 and the condenser 274.

A computer system 206, as part of the process control system 204, may contain a multi-controller algorithm utilized to control the multiple valves, pumps, and sensors within the heat engine system 200. In one embodiment, the process control system 204 is enabled to move, adjust, manipulate, or otherwise control the inventory return valve 174 and/or the inventory supply valve 184 along with operating the transfer pump 170 for mass management or inventory control of the working fluid within the working fluid circuit 202. In another embodiment, the process control system 204 is enabled to move, adjust, manipulate, or otherwise control the bearing gas supply valves 198*a* and 198*b* along with operating the transfer pump 170 to flow the working fluid over and cool the bearings within the bearing housings 268 and 238. By controlling the flow of the working fluid, the process control system 204 is also operable to regulate the mass flows, temperatures, and/or pressures throughout the working fluid circuit 202.

In some embodiments, the overall efficiency of the heat engine system 200 and the amount of power ultimately generated can be influenced by the use of the mass management system ("MMS") 270. The mass management system 270 may be utilized to control the transfer pump 170 by regulating the amount of working fluid entering and/or exiting the heat engine system 200 at strategic locations in the working fluid circuit 202, such as the inventory return line 172, the inventory supply line 182, as well as at tie-in points, inlets/outlets, valves, or conduits throughout the heat engine system 200.

In one embodiment, the mass management system 270 contains at least one storage vessel or tank, such as a mass control tank 286, configured to contain or otherwise store the working fluid therein. The mass control tank 286 may be fluidly coupled to the low pressure side of the working fluid circuit 202, may be configured to receive the working fluid from the working fluid circuit 202, and/or may be configured to distribute the working fluid into the working fluid circuit 202. The mass control tank 286 may be a storage tank/vessel, a cryogenic tank/vessel, a cryogenic storage tank/vessel, a fill tank/vessel, or other type of tank, vessel, or container fluidly coupled to the working fluid circuit 202.

The mass control tank 286 may be fluidly coupled to the low pressure side of the working fluid circuit 202 via one or more fluid lines (e.g., the inventory return/supply lines 172, 182) and valves (e.g., the inventory return/supply valves 174, 184). The valves are moveable—as being partially opened, fully opened, and/or closed—to either remove working fluid from the working fluid circuit 202 or add working fluid to the working fluid circuit 202. Exemplary embodiments of the mass management system 270, and a range of variations thereof, are found in U.S. application Ser. No. 13/278,705, filed Oct. 21, 2011, published as U.S. Pub. No. 2012-0047892, and issued as U.S. Pat. No. 8,613,195, the contents of which are incorporated herein by reference to the extent consistent with the present disclosure.

In some embodiments, the mass control tank 286 may be configured as a localized storage tank for additional/supplemental working fluid that may be added to the heat engine system 90, 200 when desired in order to regulate the pressure or temperature of the working fluid within the working fluid circuit 202 or otherwise supplement escaped working fluid. By controlling the valves, the mass management system 270 adds and/or removes working fluid mass to/from the heat engine system 200 with or without the need of a pump, thereby reducing system cost, complexity, and maintenance.

Additional or supplemental working fluid may be added to the mass control tank 286, hence, added to the mass management system 270 and the working fluid circuit 202, from an external source, such as by a fluid fill system via at least one connection point or fluid fill port, such as a working fluid feed 288. Exemplary fluid fill systems are described and illustrated in U.S. Pat. No. 8,281,593, the contents of which are incorporated herein by reference to the extent consistent with the present disclosure. In some embodiments, an additional working fluid storage vessel (not shown) may be fluidly coupled to the mass control tank 286 and utilized to contain further supplemental working fluid. In some examples, the additional working fluid storage vessel may be fluidly coupled to the mass control tank 286 via the working fluid feed 288.

In another embodiment described herein, seal gas may be supplied to components or devices contained within and/or utilized along with the heat engine system 200. One or multiple streams of seal gas may be derived from the working fluid within the working fluid circuit 202 and contain carbon dioxide in a gaseous, subcritical, or supercritical state. In some examples, the seal gas supply 298 is a connection point or valve that feeds into a seal gas system. A gas return 294 is generally coupled to a discharge, recapture, or return of seal gas and other gases. The gas return 294 provides a feed stream into the working fluid circuit 202 of recycled, recaptured, or otherwise returned gases—generally derived from the working fluid. The gas return may be fluidly coupled to the working fluid circuit 202 upstream of the condenser 274 and downstream of the recuperator 218.

The heat engine system 200 contains a process control system 204 communicably connected, wired and/or wirelessly, with numerous sets of sensors, valves, and pumps, in order to process the measured and reported temperatures, pressures, and mass flowrates of the working fluid at the designated points within the working fluid circuit 202. In response to these measured and/or reported parameters, the process control system 204 may be operable to selectively adjust the valves in accordance with a control program or algorithm, thereby maximizing operation of the heat engine system 200.

The process control system 204 may operate with the heat engine system 200 semi-passively with the aid of several sets of sensors. The first set of sensors is arranged at or adjacent the suction inlet of the turbopump 260 and the start pump 280 and the second set of sensors is arranged at or adjacent the outlet of the turbopump 260 and the start pump 280. The first and second sets of sensors monitor and report the pressure, temperature, mass flowrate, or other properties of the working fluid within the low and high pressure sides of the working fluid circuit 202 adjacent the turbopump 260 and the start pump 280. The third set of sensors may be arranged either inside or adjacent the mass control tank 286 of the mass management system 270 to measure and report the pressure, temperature, mass flowrate, or other properties of the working fluid within the mass control tank 286. Additionally, an instrument air supply (not shown) may be coupled to sensors, devices, or other instruments within the heat engine system 200 and/or the mass management system 270 that may utilized a gaseous source, such as nitrogen or air.

In some embodiments described herein, the waste heat system 100 is disposed on or in a waste heat skid 102 fluidly coupled to the working fluid circuit 202, as well as other portions, sub-systems, or devices of the heat engine system 200. The waste heat skid 102 may be fluidly coupled to a source of and an exhaust for the heat source stream 110, a main process skid 212, a power generation skid 222, and/or other portions, sub-systems, or devices of the heat engine system 200.

In one or more configurations, the waste heat system 100 disposed on or in the waste heat skid 102 generally contains inlets 122, 132, and 152 and outlets 124, 134, and 154 fluidly coupled to and in thermal communication with the working fluid within the working fluid circuit 202. The inlet 122 may be disposed upstream of the heat exchanger 120 and the outlet 124 is disposed downstream of the heat exchanger 120. The working fluid circuit 202 is configured to flow the working fluid from the inlet 122, through the heat exchanger 120, and to the outlet 124 while transferring thermal energy from the heat source stream 110 to the working fluid by the heat exchanger 120. The inlet 152 is disposed upstream of the heat exchanger 150 and the outlet 154 is disposed downstream of the heat exchanger 150. The working fluid circuit 202 is configured to flow the working fluid from the inlet 152, through the heat exchanger 150, and to the outlet 154 while transferring thermal energy from the heat source stream 110 to the working fluid by the heat exchanger 150. The inlet 132 is disposed upstream of the heat exchanger 130 and the outlet 134 is disposed downstream of the heat exchanger 130. The working fluid circuit 202 is configured to flow the working fluid from the inlet 132, through the heat exchanger 130, and to the outlet 134 while transferring thermal energy from the heat source stream 110 to the working fluid by the heat exchanger 130.

In one or more configurations, the power generation system 220 is disposed on or in the power generation skid 222 and generally contains inlets 225*a*, 225*b* and an outlet 227 fluidly coupled to and in thermal communication with the working fluid within the working fluid circuit 202. The inlets 225*a*, 225*b* are upstream of the power turbine 228 within the high pressure side of the working fluid circuit 202 and are configured to receive the heated and high pressure working fluid. In some examples, the inlet 225*a* may be fluidly coupled to the outlet 124 of the waste heat system 100 and configured to receive the working fluid flowing from the heat exchanger 120 and the inlet 225*b* may be fluidly coupled to the outlet 241 of the process system 210 and configured to receive the working fluid flowing from the turbopump 260 and/or the start pump 280. The outlet 227 is disposed downstream of the power turbine 228 within the low pressure side of the working fluid circuit 202 and is configured to provide the low pressure working fluid. In some examples, the outlet 227 may be fluidly coupled to the inlet 239 of the process system 210 and configured to flow the working fluid to the recuperator 216.

A filter 215*a* may be disposed along and in fluid communication with the fluid line at a point downstream of the heat exchanger 120 and upstream of the power turbine 228. In some examples, the filter 215*a* may be fluidly coupled to the working fluid circuit 202 between the outlet 124 of the waste heat system 100 and the inlet 225*a* of the process system 210.

The portion of the working fluid circuit 202 within the power generation system 220 is fed the working fluid by the inlets 225*a* and 225*b*. A stop valve 217 may be fluidly coupled to the working fluid circuit 202 between the inlet 225*a* and the power turbine 228. The stop valve 217 is configured to control the flow of heated working fluid flowing from the heat exchanger 120, through the inlet 225*a*, and into the power turbine 228 while in an opened position. Alternatively, the stop valve 217 may be configured to cease the flow of working fluid from entering into the power turbine 228 while in a closed position.

An attemperator valve 223 may be fluidly coupled to the working fluid circuit 202 between the inlet 225*b* and the stop valve 217 upstream of a point on the fluid line that intersects the incoming stream from the inlet 225*a*. The attemperator valve 223 is configured to control the flow of heated working fluid flowing from the start pump 280 and/or the turbopump 260, through the inlet 225*b*, and to a stop valve 217, the power turbine bypass valve 219, and/or the power turbine 228.

The power turbine bypass valve 219 may be fluidly coupled to a turbine bypass line that extends from a point of the working fluid circuit 202 upstream of the stop valve 217 and downstream of the power turbine 228. Therefore, the bypass line and the power turbine bypass valve 219 are configured to direct the working fluid around and avoid the power turbine 228. If the stop valve 217 is in a closed position, the power turbine bypass valve 219 may be configured to flow the working fluid around and avoid the power turbine 228 while in an opened position. In one embodiment, the power turbine bypass valve 219 may be utilized while warming up the working fluid during a startup operation of the electricity generating process. An outlet valve 221 may be fluidly coupled to the working fluid circuit 202 between the outlet on the power turbine 228 and the outlet 227 of the power generation system 220.

In one or more configurations, the process system 210 is disposed on or in the main process skid 212 and generally contains inlets 235, 239, and 255 and outlets 231, 237, 241, 251, and 253 fluidly coupled to and in thermal communication with the working fluid within the working fluid circuit 202. The inlet 235 is upstream of the recuperator 216 and the outlet 154 is downstream of the recuperator 216. The working fluid circuit 202 is configured to flow the working fluid from the inlet 235, through the recuperator 216, and to the outlet 237 while transferring thermal energy from the working fluid in the low pressure side of the working fluid circuit 202 to the working fluid in the high pressure side of the working fluid circuit 202 by the recuperator 216. The outlet 241 of the process system 210 is downstream of the turbopump 260 and/or the start pump 280, upstream of the power turbine 228, and configured to provide a flow of the high pressure working fluid to the power generation system 220, such as to the power turbine 228. The inlet 239 is upstream of the recuperator 216, downstream of the power turbine 228, and configured to receive the low pressure working fluid flowing from the power generation system 220, such as to the power turbine 228. The outlet 251 of the process system 210 is downstream of the recuperator 218, upstream of the heat exchanger 150, and configured to provide a flow of working fluid to the heat exchanger 150. The inlet 255 is downstream of the heat exchanger 150, upstream of the drive turbine 264 of the turbopump 260, and configured to provide the heated high pressure working fluid flowing from the heat exchanger 150 to the drive turbine 264 of the turbopump 260. The outlet 253 of the process system 210 is downstream of the pump portion 262 of the turbopump 260 and/or the pump portion 282 of the start pump 280, couples a bypass line disposed downstream of the heat exchanger 150 and upstream of the drive turbine 264 of the turbopump 260, and configured to provide a flow of working fluid to the drive turbine 264 of the turbopump 260.

Additionally, a filter 215*c* may be disposed along and in fluid communication with the fluid line at a point downstream of the heat exchanger 150 and upstream of the drive turbine 264 of the turbopump 260. In some examples, the filter 215*c* may be fluidly coupled to the working fluid circuit 202 between the outlet 154 of the waste heat system 100 and the inlet 255 of the process system 210.

In another embodiment described herein, as illustrated in FIG. 8, the heat engine system 200 contains the process system 210 disposed on or in a main process skid 212, the power generation system 220 disposed on or in a power generation skid 222, the waste heat system 100 disposed on or in a waste heat skid 102. The working fluid circuit 202 extends throughout the inside, the outside, and between the main process skid 212, the power generation skid 222, the waste heat skid 102, as well as other systems and portions of the heat engine system 200. In some embodiments, the heat engine system 200 contains the bypass line 160 and the bypass valve 162 disposed between the waste heat skid 102 and the main process skid 212. A filter 215*b* may be disposed along and in fluid communication with the fluid line 135 at a point downstream of the heat exchanger 130 and upstream of the recuperator 216. In some examples, the filter 215*b* may be fluidly coupled to the working fluid circuit 202 between the outlet 134 of the waste heat system 100 and the inlet 235 of the process system 210.

In other exemplary embodiments, a method is provided and includes controlling the rate of mass addition and removal in the heat engine systems 90, 200 while maintaining the working fluid system 202 free of or substantially free of disturbances. In some examples, managing the inventory of the system simply by adding or removing mass (the working fluid) while ignoring the rate of such addition or removal of the working fluid does not always achieve the desired and efficient result. If removing or adding too much mass at a given time will cause the speed of the turbopump 260 to oscillate in a manner that sometimes cannot be controlled by the process control system 204, then these oscillations may also prevent the operation of the turbopump 260 at its design states for optimum performance and efficiency, because if the working fluid circuit 202 is originally at its design pressure in the high pressure side, and the speed of the turbopump 260 increases during an oscillation, then the high pressure side may overpressure.

In these exemplary configurations, if the pressure of the low pressure side exceeds a desirable or predetermined value, and too much mass (the working fluid) is removed at one time, the pressure of the low pressure side drops dramatically, the pressure drop across the drive turbine 264 of the turbopump 260 increases, the rotational speed of the pump portion 262 of the turbopump 260 increases, and the pressure of the high pressure side also increases. Increasing the pressure of the high pressure side pulls mass (the working fluid) from the low pressure side and the effects are compounded throughout the working fluid circuit 202. If the turbopump 260 or other components within the heat engine systems 90, 200 are already at a design pressure for the high pressure side, a component may overpressure during the speed increase. Adding too much mass (the working fluid) may slow down the turbopump 260 and may reduce the pressure of the high pressure side, forcing the heat engine systems 90, 200 to run at a less-than-optimal point.

In one embodiment, the following example is provided for the heat engine systems 90, 200. The pressure of the low pressure side may be maintained at less than about 1,500 psi (about 10.3 MPa) due to potential material limits of some components within the heat engine systems 90, 200. The low end limit may be set by the inlet conditions to the pumps in order to prevent cavitation, P>Psat. The high pressure side may stay less than about 3,400 psi (about 23.4 MPa), also due to potential material limits of some components within the heat engine systems 90, 200. The speed of the turbopump 260 may be closely adjusted relative to the pressure in the high pressure side of the working fluid circuit 202; generally, as the speed increases, the pressure also increases. The heat engine systems 90, 200 may be sensitive to changes in the pressure of the low pressure side of the working fluid circuit 202. In these examples, when the temperature of the high pressure side increases by adding heat with the heat exchangers (the heat exchangers 120, 130, and/or 150), the system pressures (both high and low pressure side) increase. To prevent overpressure, mass (the working fluid) may be removed from the working fluid circuit 202. Opening one or more valves (e.g., the tank transfer valve 142 or the inventory return valve 174) for removing mass (the working fluid) introduces a step change (a large pipe at a pressure of about 300 psi (approximately 2.1 MPa) may be instantaneously filled with the working fluid to have a pressure similar or the same as the low pressure side, such as at a pressure of about 1,000 psi (approximately 6.9 MPa) in the pressure of the low pressure side, which may cause the "snowball effect" in changes of pressures throughout the system. The process control system 204 would otherwise be able to handle these dramatic changes, but only after a few oscillations of the speed and output pressure of the turbopump 260.

Therefore, if operating at the design pressure of the high pressure side of about 3,400 psi (approximately 23.4 MPa), and a step change in the pressure of the low pressure side is introduced, then the working fluid circuit 202 may overpressurize. In many embodiments, the maximum turbine work (e.g., by the power turbine 228 or the drive turbine 264) may be utilized when the pressure drop across it is the greatest. Therefore, the pressure of the low pressure side may be adjusted as low as possible, such as, for example, within a range from about 50 psi (approximately 0.34 MPa) to about 100 psi (approximately 0.69) greater than Psat. Adding or removing significant amount of mass at this point would also yield pressure oscillations that could potentially cause the pump portion 262 to cavitate. Therefore, the process control system 204 may be configured to operate the one or more valves (e.g., the tank transfer valve 142 or the inventory return valve 174) for removing mass (the working fluid) from the working fluid circuit 202.

It is to be understood that the present disclosure describes several exemplary embodiments for implementing different features, structures, or functions of the disclosure. Exemplary embodiments of components, arrangements, and configurations are described herein to simplify the present disclosure, however, these exemplary embodiments are provided merely as examples and are not intended to limit the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit having a high pressure side and a low pressure side and being configured to flow a working fluid therethrough, wherein at least a portion of the working fluid circuit contains the working fluid in a supercritical state, and the working fluid comprises carbon dioxide;

a heat exchanger fluidly coupled to and in thermal communication with the high pressure side of the working fluid circuit, configured to be fluidly coupled to and in thermal communication with a heat source, and configured to transfer thermal energy from the heat source to the working fluid within the high pressure side;

an expander fluidly coupled to the working fluid circuit and disposed between the high pressure side and the low pressure side and configured to convert a pressure drop in the working fluid to mechanical energy;

a driveshaft coupled to the expander and configured to drive a device with the mechanical energy;

a system pump fluidly coupled to the working fluid circuit between the low pressure side and the high pressure side of the working fluid circuit and configured to circulate or pressurize the working fluid within the working fluid circuit;

a recuperator fluidly coupled to the working fluid circuit and operative to transfer thermal energy between the high pressure side and the low pressure side of the working fluid circuit;

a cooler in thermal communication with the working fluid in the low pressure side of the working fluid circuit and configured to remove thermal energy from the working fluid in the low pressure side of the working fluid circuit; and a mass management system fluidly coupled to the low pressure side of the working fluid circuit and comprising:

an inventory transfer line fluidly coupled to the low pressure side of the working fluid circuit and configured to transfer the working fluid from and to the working fluid circuit on the low pressure side;

a mass control tank fluidly coupled to the inventory transfer line and configured to receive, store, and dispense the working fluid;

a system transfer valve coupled to the inventory transfer line and configured to control the transfer of the working fluid from and to the working fluid circuit; and a tank transfer valve coupled to the inventory transfer line and configured to control the transfer of the working fluid from and to the mass control tank.

2. The heat engine system of claim 1, wherein the system transfer valve and the tank transfer valve each comprises an isolation shut-off valve or a modulating valve.

3. A method for transferring the working fluid between the mass management system and the working fluid circuit within the heat engine system of claim 1, comprising:

providing the system transfer valve in a closed position and the tank transfer valve in an opened position;

circulating the working fluid within the working fluid circuit;

providing a high pressure in the high pressure side of the working fluid circuit within a high pressure threshold range;

providing a low pressure in the low pressure side of the working fluid circuit within a low pressure threshold range;

monitoring the low pressure via a process control system operatively connected to the working fluid circuit;

detecting an undesirable value of the low pressure via the process control system, wherein the undesirable value is less than or greater than the low pressure threshold range;

adjusting the system transfer valve to an opened position;

transferring the working fluid between the working fluid circuit and the mass control tank;

detecting a desirable value of the low pressure via the process control system, wherein the desirable value is within the low pressure threshold range; and adjusting the system transfer valve to the closed position.

4. A heat engine system, comprising:

a working fluid circuit having a high pressure side and a low pressure side and being configured to flow a working fluid therethrough, wherein at least a portion of the working fluid circuit contains the working fluid in a supercritical state, and the working fluid comprises carbon dioxide;

a heat exchanger fluidly coupled to and in thermal communication with the high pressure side of the working fluid circuit, configured to be fluidly coupled to and in thermal communication with a heat source, and configured to transfer thermal energy from the heat source to the working fluid within the high pressure side;

an expander fluidly coupled to the working fluid circuit and disposed between the high pressure side and the low pressure side and configured to convert a pressure drop in the working fluid to mechanical energy;

a driveshaft coupled to the expander and configured to drive a device with the mechanical energy;

a system pump fluidly coupled to the working fluid circuit between the low pressure side and the high pressure side of the working fluid circuit and configured to circulate or pressurize the working fluid within the working fluid circuit;

a recuperator fluidly coupled to the working fluid circuit and operative to transfer thermal energy between the high pressure side and the low pressure side of the working fluid circuit;

a cooler in thermal communication with the working fluid in the low pressure side of the working fluid circuit and configured to remove thermal energy from the working fluid in the low pressure side of the working fluid circuit; and a mass management system fluidly coupled to the low pressure side of the working fluid circuit and comprising:

an inventory transfer line fluidly coupled to the low pressure side of the working fluid circuit and configured to transfer the working fluid from and to the working fluid circuit on the low pressure side;

a mass control tank fluidly coupled to the inventory transfer line and configured to receive, store, and dispense the working fluid;

a system transfer valve coupled to the inventory transfer line and configured to control the transfer of the working fluid from and to the working fluid circuit;

a tank transfer valve coupled to the inventory transfer line and configured to control the transfer of the working fluid from and to the mass control tank; and a transfer pump in fluid communication with the mass control tank and the inventory transfer line and configured to control the pressure of a section of the inventory transfer line disposed between the system and tank transfer valves.

5. The heat engine system of claim 4, wherein the system transfer valve and the tank transfer valve each comprises an isolation shut-off valve or a modulating valve.

6. The heat engine system of claim 4, wherein the transfer pump is configured to transfer the working fluid from the mass control tank to the working fluid circuit.

7. The heat engine system of claim 4, further comprising a transfer pump line fluidly coupled to and disposed between the mass control tank and the inventory transfer line.

8. The heat engine system of claim 4, further comprising a restricted flow device fluidly coupled within the inventory transfer line and disposed between the system and tank transfer valves, wherein the restricted flow device is configured to reduce a flowrate of the working fluid flowing from the system transfer valve towards the tank transfer valve.

9. The heat engine system of claim 8, further comprising a bypass line in fluid communication with the inventory transfer line and configured to circumvent the restricted flow device, wherein a first end of the bypass line is fluidly coupled to the inventory transfer line and disposed between the system transfer valve and the restricted flow device, and a second end of the bypass line is fluidly coupled to the inventory transfer line and disposed between the tank transfer valve and the restricted flow device.

10. The heat engine system of claim 8, further comprising a bypass valve fluidly coupled to the inventory transfer line and configured to control the flow of the working fluid circumventing the restricted flow device.

11. A method for transferring the working fluid between the mass management system and the working fluid circuit within the heat engine system of claim 4, comprising:

providing the system transfer valve in an opened position and the tank transfer valve in a closed position;

circulating the working fluid within the working fluid circuit;

providing a high pressure in the high pressure side of the working fluid circuit within a high pressure threshold range;

providing a low pressure in the low pressure side of the working fluid circuit within a low pressure threshold range;

pressurizing, with the transfer pump, the section of the inventory transfer line disposed between the system and tank transfer valves to a transfer pressure within the low pressure threshold range;

monitoring the low pressure via a process control system operatively connected to the working fluid circuit;

detecting an undesirable value of the low pressure via the process control system, wherein the undesirable value is less than or greater than the low pressure threshold range;

adjusting the tank transfer valve to transfer the working fluid between the working fluid circuit and the mass control tank;

detecting a desirable value of the low pressure via the process control system, wherein the desirable value is within the low pressure threshold range; and adjusting the tank transfer valve to the closed position.

12. The method of claim 11, further comprising modulating the system transfer valve while transferring the working fluid between the working fluid circuit and the mass control tank.

* * * * *